US010271605B2

(12) United States Patent
Withnall et al.

(10) Patent No.: US 10,271,605 B2
(45) Date of Patent: Apr. 30, 2019

(54) PROTECTIVE SPORTS HELMET

(71) Applicant: Riddell, Inc., Rosemont, IL (US)

(72) Inventors: Chris Withnall, Nepean (CA); Michael Wonnacott, Ottawa (CA); Vittorio Bologna, Medinah, IL (US); Thad M. Ide, Chicago, IL (US); Ralph Infusino, Bloomingdale, IL (US); Nelson Kraemer, Mount Prospect, IL (US)

(73) Assignee: Riddell, Inc., Des Plaines, IL (US)

( * ) Notice: Subject to any disclaimer, the term of this patent is extended or adjusted under 35 U.S.C. 154(b) by 0 days.

(21) Appl. No.: 16/007,635

(22) Filed: Jun. 13, 2018

(65) Prior Publication Data

US 2018/0295923 A1 Oct. 18, 2018

Related U.S. Application Data

(63) Continuation of application No. 15/076,106, filed on Mar. 21, 2016, which is a continuation of application (Continued)

(51) Int. Cl.

*A42B 1/06* (2006.01)
*A42B 3/20* (2006.01)

(Continued)

(52) U.S. Cl.

CPC ..... *A42B 3/20* (2013.01); *A42B 3/0406* (2013.01); *A42B 3/08* (2013.01); *A42B 3/28* (2013.01);

(Continued)

(58) Field of Classification Search

CPC ..... A42B 3/20; A42B 3/08; A42B 3/0406; A42B 3/16; A42B 3/28; A42B 3/281;

(Continued)

(56) References Cited

U.S. PATENT DOCUMENTS 622,677 A 4/1899 Gallagher
1,060,220 A 4/1913 White (Continued)

FOREIGN PATENT DOCUMENTS

CH 692011 1/2002
DE 3222681 6/1982

(Continued)

OTHER PUBLICATIONS

Defendant Schutt's First Supplemental Responses to Plaintiff Riddell's First Set of Interrogatories.

(Continued)

*Primary Examiner* — Katharine Gracz
(74) *Attorney, Agent, or Firm* — Barnes & Thornburg LLP

(57) ABSTRACT

A protective sports helmet that includes an energy attenuating faceguard connection system, which includes at least one connector that secures the faceguard to the helmet shell without a connection point in the shell's brow region. The sports helmet can be configured as a football helmet to be worn by a player and where the lack of a brow region connection point results in a gap or clearance between the faceguard and the shell that has a functional interplay with the connector upon an impact to the faceguard. The football helmet has a unique collection of helmet shell features that include an arrangement of a raised central band, lateral ridges, frontal vent openings and rear vent openings.

29 Claims, 19 Drawing Sheets

Related U.S. Application Data

No. 13/068,104, filed on May 2, 2011, now Pat. No. 9,289,024, which is a continuation-in-part of application No. 12/082,920, filed on Apr. 15, 2008, now Pat. No. 8,813,269.

(60) Provisional application No. 60/923,603, filed on Apr. 16, 2007, provisional application No. 61/343,567, filed on Apr. 30, 2010.

(51) Int. Cl.

| | |
|---|---|
| ***A42B 3/04*** | (2006.01) |
| ***A42B 3/08*** | (2006.01) |
| ***A63B 71/08*** | (2006.01) |
| ***A63B 71/10*** | (2006.01) |
| ***A42B 3/28*** | (2006.01) |
| *A63B 102/24* | (2015.01) |
| *A63B 102/14* | (2015.01) |
| *A63B 102/22* | (2015.01) |

(52) U.S. Cl.

CPC ..... *A63B 71/081* (2013.01); *A63B 71/10* (2013.01); *A63B 2102/14* (2015.10); *A63B 2102/22* (2015.10); *A63B 2102/24* (2015.10); *A63B 2209/10* (2013.01); *A63B 2243/007* (2013.01)

(58) Field of Classification Search

CPC ... A63B 71/10; A63B 71/081; A63B 2102/24; A63B 2102/14; A63B 2209/10; A63B 2102/22

See application file for complete search history.

(56) References Cited

U.S. PATENT DOCUMENTS 1,080,690 A 12/1913 Hipkiss
1,203,564 A 11/1916 April
1,262,818 A 4/1918 McGill
1,449,183 A 3/1923 Johnstone
1,522,952 A 1/1925 Goldsmith
1,602,727 A 10/1926 Turner
1,637,692 A 8/1927 Fitzpatrick
1,655,007 A 1/1928 Boettge
1,669,914 A 5/1928 Rogers
1,691,202 A 11/1928 Van La
1,705,879 A 3/1929 Rodgers
1,714,275 A 5/1929 Mullins
D80,880 S 4/1930 Dickman
D81,055 S 4/1930 Heater
1,833,708 A 11/1931 Ford
1,839,657 A 1/1932 Duchek
1,841,232 A 1/1932 Wells
1,842,953 A 1/1932 Turner
1,868,926 A 7/1932 Tatore
1,892,943 A 1/1933 Geyer
1,997,187 A 4/1935 Taylor
D100,972 S 8/1936 Pryale
2,081,335 A 5/1937 Levinson
2,105,028 A 1/1938 Dickhoff
2,105,607 A 1/1938 McMillan
2,125,854 A 8/1938 Standley
2,140,716 A * 12/1938 Pryale ..... A42B 3/12 2/414
2,150,290 A 3/1939 Mulvey
2,194,903 A 3/1940 Holstein
D123,638 S 11/1940 Perrin
2,250,275 A 7/1941 Riddell
2,250,375 A 7/1941 Hegan
2,293,308 A 8/1942 Riddell, Jr.
2,296,335 A 9/1942 Brady
2,354,840 A 8/1944 Seletz
2,359,387 A 10/1944 Riddell
2,373,083 A 4/1945 Brewster
2,451,483 A 10/1948 Goldsmith
2,515,807 A 7/1950 Spooner
2,525,389 A 10/1950 Zeller
2,570,182 A 10/1951 Daly
2,634,415 A 4/1953 Havey
D171,297 S 1/1954 D'Arbeloff
2,679,046 A 5/1954 Dye
2,688,747 A 9/1954 Marx
2,758,304 A 8/1956 McGowan
2,768,380 A 10/1956 Golomb
2,777,127 A 1/1957 Marietta
2,779,228 A 1/1957 Meepos
2,785,404 A 3/1957 Strohm
2,785,405 A 3/1957 Snyder
D180,239 S 5/1957 McMurry
2,793,365 A 5/1957 Kleinman
2,850,740 A 9/1958 Adams
2,861,272 A 11/1958 Huxtable
2,863,151 A 12/1958 Morgan, Jr.
2,867,811 A 1/1959 Jones
2,890,457 A 6/1959 Marietta
2,904,645 A 9/1959 Sarles
2,944,263 A 7/1960 Fischer
2,969,546 A 1/1961 Morgan, Jr.
2,985,883 A 5/1961 Marietta
2,986,739 A 6/1961 Rozzi, Sr.
3,039,108 A 6/1962 Lohrenz
3,055,013 A 9/1962 Aileo
3,088,002 A 4/1963 Heisig
3,097,559 A 7/1963 Chapman
3,106,716 A 10/1963 Beebe
3,113,318 A 12/1963 Marietta
3,117,484 A 1/1964 Myers
3,122,752 A 3/1964 Marietta
3,139,624 A 7/1964 Humphrey
3,155,981 A 11/1964 McKissick
3,166,761 A 1/1965 Strohm
3,167,783 A 2/1965 Wolfe
3,174,155 A 3/1965 Pitman
3,186,004 A 6/1965 Carlini
3,187,342 A 6/1965 Aileo
3,189,917 A 6/1965 Sims
3,197,784 A 8/1965 Carlisle
3,208,080 A 9/1965 Hirsch
3,216,023 A 11/1965 Morgan
3,223,086 A 12/1965 Denton
3,263,236 A 8/1966 Humphrey
3,274,612 A 9/1966 Merriam
3,274,613 A 9/1966 Sowle
3,283,336 A 11/1966 Critser
3,292,180 A 12/1966 Marietta
3,296,582 A 1/1967 Ide
3,315,272 A 4/1967 Olt
3,323,134 A 6/1967 Swyers
3,327,313 A 6/1967 Oliver
3,364,499 A 1/1968 Kwoka
D212,582 S 11/1968 Hill
3,418,657 A 12/1968 Peter
D213,085 S 1/1969 Wyckoff
3,447,162 A 6/1969 Aileo
3,462,763 A 8/1969 Gooding
3,478,365 A 11/1969 Varga
D216,988 S 3/1970 Je Rue
3,500,472 A 3/1970 Castellani
D217,894 S 6/1970 Mikita
3,548,409 A 12/1970 Aileo
3,548,410 A * 12/1970 Parker ..... A42B 3/0493 2/10
3,551,911 A 1/1971 Holden
3,566,409 A 3/1971 Hopper
3,568,210 A 3/1971 Marietta
3,577,562 A 5/1971 Holt
3,590,388 A 7/1971 Holt
3,600,714 A 8/1971 Greathouse
D221,923 S 9/1971 Jones
3,605,113 A 9/1971 Marietta
3,609,764 A 10/1971 Morgan
3,616,463 A 11/1971 Summers

(56) References Cited

U.S. PATENT DOCUMENTS 3,619,813 A 11/1971 Marchello
3,629,864 A 12/1971 Latina
3,713,640 A 1/1973 Margan
3,720,955 A 3/1973 Rawlings
3,729,744 A 5/1973 Rappleyea
3,729,746 A 5/1973 Humphrey
D228,211 S 8/1973 O'Connor
3,751,728 A 8/1973 Thompkins
3,761,959 A 10/1973 Dunning
3,783,450 A 1/1974 O Connor
3,787,895 A 1/1974 Belvedere
3,793,241 A 2/1974 Kistner
D230,911 S 3/1974 Ispas
3,815,152 A 6/1974 Bednarczuk
3,818,508 A 6/1974 Lammers
3,820,163 A 6/1974 Rappleyea
3,843,970 A 10/1974 Marietta
3,849,801 A 11/1974 Holt
3,854,146 A 12/1974 Dunning
3,860,966 A 1/1975 Brown
D234,549 S 3/1975 Bell
3,872,511 A 3/1975 Nichols
3,882,547 A 5/1975 Morgan
3,889,296 A 6/1975 Martin
D235,941 S 7/1975 Stock
3,897,597 A 8/1975 Kasper
3,916,446 A 11/1975 Gooding
D237,844 S 12/1975 Stock
3,934,271 A 1/1976 Rhee
3,994,020 A 11/1976 Villari
3,994,021 A 11/1976 Villari
3,994,022 A * 11/1976 Villari ..... A42B 3/121 2/413
3,999,220 A 12/1976 Keltner
4,023,209 A 5/1977 Frieder
4,023,213 A 5/1977 Rovani
4,028,743 A 6/1977 Christensen
4,044,400 A 8/1977 Lewicki
4,060,855 A 12/1977 Rappleyea
4,075,714 A * 2/1978 Ryder ..... A42B 3/0493 2/421
4,086,664 A 5/1978 Humphrey
4,101,983 A 7/1978 Dera
4,136,403 A 1/1979 Walther
D254,100 S 2/1980 Breger
4,204,566 A 5/1980 Kirrish
D255,394 S 6/1980 McNabb
D256,626 S 7/1980 Antonino
D257,073 S 9/1980 Jenkins
4,233,687 A 11/1980 Lancellotti
4,272,853 A 6/1981 Schuessler
4,279,038 A 7/1981 Bruckner
4,282,610 A 8/1981 Steigerwald
4,287,613 A 9/1981 Schulz
4,307,471 A 12/1981 Lovell
4,326,303 A 4/1982 Rappleyea
D265,520 S 7/1982 Gooding
D266,626 S 10/1982 Gooding
D266,627 S 10/1982 Gooding
4,354,284 A 10/1982 Gooding
D267,287 S 12/1982 Gooding
4,363,140 A 12/1982 Correale
4,370,759 A 2/1983 Zide
4,390,995 A 7/1983 Walck
4,398,306 A 8/1983 Gooding
4,404,690 A 9/1983 Farquharson
D271,249 S 11/1983 Farquharson
D271,347 S 11/1983 Bourque
4,434,514 A * 3/1984 Sundahl ..... A42B 3/281 2/171.3
4,461,044 A 7/1984 Reiterman
4,463,456 A 8/1984 Hanson
4,475,248 A 10/1984 L'Abbe
4,477,929 A 10/1984 Mattsson
4,566,137 A 1/1986 Gooding
D283,268 S 4/1986 Rebiskie
4,587,677 A 5/1986 Clement
D285,980 S 10/1986 McNabb
4,627,115 A 12/1986 Broersma
4,633,531 A 1/1987 Nimmons
4,646,368 A 3/1987 Infusino
4,651,356 A 3/1987 Zide
4,665,569 A 5/1987 Santini
4,667,348 A 5/1987 Sundahl
4,677,694 A 7/1987 Crow
4,692,947 A 9/1987 Black
4,706,305 A 11/1987 Cho
D295,800 S 5/1988 Shelton, Jr.
D295,902 S 5/1988 Foulkes
4,741,054 A 5/1988 Mattes
4,744,107 A 5/1988 Fohl
4,766,614 A 8/1988 Cantwell
4,766,616 A 8/1988 Donahue
4,774,729 A 10/1988 Coates
D298,367 S 11/1988 Ball
4,794,652 A 1/1989 Piech von Planta
D299,978 S 2/1989 Chiarella
4,808,469 A 2/1989 Hiles
4,831,668 A 5/1989 Schulz
4,837,866 A 6/1989 Rector
4,853,980 A 8/1989 Zarotti
4,866,792 A 9/1989 Arai
D303,851 S 10/1989 Gentes
4,885,806 A 12/1989 Heller
4,885,807 A 12/1989 Snow
4,903,346 A 2/1990 Reddemann
4,903,350 A 2/1990 Gentes
4,903,381 A 2/1990 Fohl
4,916,759 A 4/1990 Arai
4,926,503 A 5/1990 Wingo, Jr.
D309,512 S 7/1990 Crow
4,937,888 A 7/1990 Straus
4,947,490 A 8/1990 Hayden
4,980,110 A 12/1990 Nelson et al.
5,014,365 A 5/1991 Schulz
5,023,958 A 6/1991 Rotzin
5,035,009 A 7/1991 Wingo
D319,112 S 8/1991 Broersma
5,044,016 A 9/1991 Coombs
5,061,112 A 10/1991 Monford
5,083,321 A 1/1992 Davidsson
5,090,061 A 2/1992 Kamata
5,093,936 A 3/1992 Copeland
5,093,937 A 3/1992 Kamata
5,093,939 A 3/1992 Noyerie
5,100,272 A 3/1992 Jadoul
5,101,517 A 4/1992 Douglas
5,119,516 A 6/1992 Broersma
5,129,108 A 7/1992 Copeland
5,136,728 A 8/1992 Kamata
5,142,700 A 8/1992 Reed
5,165,116 A 11/1992 Simpson
D331,645 S 12/1992 Gallet
D332,507 S 1/1993 Anderson
5,175,889 A 1/1993 Infusino
5,177,815 A 1/1993 Andujar
5,177,816 A 1/1993 Schmidt
5,203,034 A 4/1993 Foehl
5,206,955 A 5/1993 Milligan
5,231,703 A 8/1993 Garneau
D339,427 S 9/1993 Gentes
5,263,203 A 11/1993 Kraemer
5,263,204 A 11/1993 Butsch
5,267,353 A 12/1993 Milligan
5,271,103 A 12/1993 Darnell
5,287,562 A 2/1994 Rush
5,291,880 A 3/1994 Almovist
5,293,649 A 3/1994 Corpus
D347,300 S 5/1994 Gentes
D348,545 S 7/1994 Egger
D348,752 S 7/1994 Ho
RE34,699 E 8/1994 Copeland
D350,710 S 9/1994 Keiffer
5,347,660 A 9/1994 Zide

(56) References Cited

U.S. PATENT DOCUMENTS

D352,802 S 11/1994 Jeng
D352,803 S 11/1994 Sasaki
D355,394 S 2/1995 Brezener
D357,554 S 4/1995 Garneau
D357,555 S 4/1995 Brueckner
D358,003 S 5/1995 Losi, II
D358,004 S 5/1995 Losi, II
D358,232 S 5/1995 Hoshizaki
D358,905 S 5/1995 Stinson
5,412,814 A 5/1995 Pernicka
5,418,257 A 5/1995 Weisman
D361,407 S 8/1995 Ho
D361,408 S 8/1995 Ho
D361,409 S 8/1995 Ho
D362,084 S 9/1995 Egger
5,448,780 A 9/1995 Gath
5,450,631 A 9/1995 Egger
5,452,979 A 9/1995 Cosenza
5,461,730 A 10/1995 Carrington
D364,487 S 11/1995 Tutton
5,483,699 A 1/1996 Pernicka
5,493,736 A 2/1996 Allison
5,494,323 A 2/1996 Huang
5,502,843 A 4/1996 Strickland
5,522,091 A 6/1996 Rudolf
D371,867 S 7/1996 Losi, II
D371,868 S 7/1996 Losi, II
D371,869 S 7/1996 Chen
D372,342 S 7/1996 Chen
5,539,936 A 7/1996 Thomas
5,553,330 A 9/1996 Carveth
D378,236 S 2/1997 Zanotto
D378,624 S 3/1997 Chartrand
D380,870 S 7/1997 Szabados
D382,671 S 8/1997 Shewchenko
5,655,227 A 8/1997 Sundberg
D383,953 S 9/1997 DeFilippo
5,661,854 A 9/1997 March
5,675,875 A 10/1997 Servatius
D387,501 S 12/1997 Cheng
D388,551 S 12/1997 Lu
D389,280 S 1/1998 Ho
5,713,082 A 2/1998 Bassette
5,724,681 A 3/1998 Sykes
5,732,414 A * 3/1998 Monica ..... A42B 3/003 2/209.13
5,734,994 A 4/1998 Rogers
5,737,770 A 4/1998 Chen
5,790,988 A 8/1998 Guadagnino
5,794,274 A 8/1998 Kraemer
5,799,337 A 9/1998 Brown
5,829,065 A 11/1998 Cahill
5,867,840 A 2/1999 Hirosawa
D406,399 S 3/1999 Hohdorf
5,883,145 A 3/1999 Hurley
D408,236 S 4/1999 Rennick
5,913,412 A 6/1999 Huber
5,915,537 A 6/1999 Dallas
D412,376 S 7/1999 Jurga
D412,766 S * 8/1999 Tang ..... D29/106
5,930,840 A 8/1999 Arai
5,938,878 A 8/1999 Hurley
5,940,890 A 8/1999 Dallas
5,943,706 A 8/1999 Miyajima
5,946,735 A 9/1999 Bayes
5,950,244 A 9/1999 Fournier
5,953,761 A 9/1999 Jurga
5,956,777 A 9/1999 Popovich
D415,593 S 10/1999 Tang
5,963,990 A * 10/1999 White ..... A42B 3/20 2/424
5,966,744 A 10/1999 Smith
5,978,973 A 11/1999 Chartrand
5,991,930 A 11/1999 Sorrentino
6,047,400 A 4/2000 Spencer
D426,677 S 6/2000 Ho
6,070,271 A 6/2000 Williams
6,073,271 A 6/2000 Alexander
6,078,053 A 6/2000 Adam
6,079,053 A 6/2000 Clover
6,081,932 A 7/2000 Kraemer
6,128,786 A 10/2000 Maddux
6,138,283 A 10/2000 Kress
6,138,284 A 10/2000 Arai
6,154,889 A 12/2000 Moore
6,159,324 A 12/2000 Watters
6,178,560 B1 1/2001 Halstead
6,189,156 B1 * 2/2001 Loiars ..... A42B 3/20 2/424
6,199,219 B1 3/2001 Silken
6,219,850 B1 * 4/2001 Halstead ..... A42B 3/06 2/414
6,226,801 B1 5/2001 Alexander
D444,268 S 6/2001 Montello
6,240,571 B1 6/2001 Infusino
D445,218 S 7/2001 Watters
D445,962 S 7/2001 Brignone
6,256,798 B1 7/2001 Egolf
6,266,827 B1 7/2001 Lampe
6,272,692 B1 8/2001 Abraham
D447,604 S 9/2001 Watters
D448,526 S 9/2001 Brignone
6,282,726 B1 9/2001 Noyerie
D448,890 S 10/2001 Brignone
6,298,483 B1 10/2001 Schiebl
6,298,497 B1 10/2001 Chartrand
6,301,719 B1 10/2001 Goodhand
6,305,030 B1 * 10/2001 Brignone ..... A42B 3/0493 2/425
6,321,386 B1 11/2001 Monica
6,324,701 B1 12/2001 Alexander
6,332,228 B1 * 12/2001 Takahara ..... A42B 3/003 2/422
6,339,849 B1 1/2002 Nelson
D453,399 S 2/2002 Racine
6,351,853 B1 3/2002 Halstead
6,360,376 B1 3/2002 Carrington
6,370,699 B1 4/2002 Halstead
6,385,780 B1 5/2002 Racine
6,389,607 B1 5/2002 Wood
D459,032 S * 6/2002 Gatellet ..... D29/106
D459,554 S * 6/2002 Gatellet ..... D29/106
D459,555 S 6/2002 Gatellet
6,421,841 B2 7/2002 Ikeda
6,434,755 B1 8/2002 Halstead
6,438,762 B1 * 8/2002 Jenkins ..... A42B 3/10 2/267
6,438,763 B2 8/2002 Guay
6,442,765 B1 9/2002 Fallon
6,446,270 B1 9/2002 Durr
D465,067 S * 10/2002 Ide ..... D29/106
6,467,099 B2 10/2002 Dennis
6,481,024 B1 11/2002 Grant
D466,651 S 12/2002 Halstead
6,499,139 B1 12/2002 Brown
6,499,147 B2 12/2002 Schiebl
6,532,602 B2 3/2003 Watters
D475,486 S 6/2003 Ide
6,604,246 B1 8/2003 Obreja
6,701,535 B2 3/2004 Dobbie
6,722,711 B2 4/2004 Kitzis
D492,818 S 7/2004 Ide
6,772,447 B2 8/2004 Morrow
D495,838 S 9/2004 Arai
D496,762 S 9/2004 Durocher
6,826,509 B2 11/2004 Crisco, III
6,874,170 B1 4/2005 Aaron
6,880,176 B2 4/2005 Timms
6,925,657 B2 8/2005 Takahashi
6,931,671 B2 8/2005 Skiba
6,934,971 B2 * 8/2005 Ide ..... A42B 3/08 2/424
D509,928 S 9/2005 Barnoski
6,938,272 B1 9/2005 Brown

(56) References Cited

U.S. PATENT DOCUMENTS

D511,026 S * 10/2005 Ide ..... D29/107
6,961,963 B2 11/2005 Rosie
D512,534 S * 12/2005 Maddux ..... D29/106
7,036,151 B2 5/2006 Ide
D528,705 S * 9/2006 Ide ..... D29/122
7,146,652 B2 * 12/2006 Ide ..... A42B 3/08 2/422
7,240,376 B2 * 7/2007 Ide ..... A42B 3/08 2/425
7,328,462 B1 2/2008 Straus
D566,903 S 4/2008 Rogers
D575,458 S 8/2008 Ho
7,430,767 B2 10/2008 Nagely
D581,599 S * 11/2008 Ferrara ..... D29/106
D582,607 S * 12/2008 Ferrara ..... D29/106
D587,407 S * 2/2009 Nimmons ..... D29/106
D587,852 S 3/2009 Nimmons
D587,853 S * 3/2009 Nimmons ..... D29/106
D587,854 S * 3/2009 Nimmons ..... D29/106
D587,855 S * 3/2009 Nimmons ..... D29/106
D587,857 S 3/2009 Nimmons
D590,106 S 4/2009 Nimmons
D592,809 S * 5/2009 Broersma ..... D29/106
D598,610 S 8/2009 Soukup et al.
D603,099 S * 10/2009 Bologna ..... D29/106
D603,100 S * 10/2009 Bologna ..... D29/106
D616,154 S 5/2010 Daniel
7,735,160 B1 6/2010 Schiebl
7,743,640 B2 6/2010 Lampe
7,774,866 B2 8/2010 Ferrara
D625,050 S 10/2010 Chen
D628,347 S * 11/2010 Chen ..... D29/106
7,832,023 B2 11/2010 Crisco
D628,748 S 12/2010 Stewart
D628,749 S * 12/2010 Daniel ..... D29/105
D629,162 S 12/2010 Daniel
7,870,617 B2 1/2011 Butler
D633,658 S 3/2011 Daniel
7,900,279 B2 3/2011 Kraemer
D636,536 S * 4/2011 Lee ..... D29/106
D637,767 S 5/2011 Morin
7,954,177 B2 6/2011 Ide
7,975,320 B2 7/2011 Muskovitz
7,987,525 B2 8/2011 Summers
D654,227 S 2/2012 Stout
D654,629 S * 2/2012 Chou ..... D29/106
D654,630 S * 2/2012 Chou ..... D29/106
D654,632 S * 2/2012 Chou ..... D29/106
8,117,679 B2 2/2012 Pierce
8,146,178 B2 4/2012 Maddux
8,209,784 B2 * 7/2012 Nimmons ..... A42B 3/20 2/411
D670,447 S * 11/2012 Emrich ..... D29/106
D671,687 S * 11/2012 Winningham ..... D29/102
8,418,270 B2 4/2013 Desjardins
8,453,269 B2 6/2013 Hampton, II
8,499,366 B2 8/2013 Nimmons
8,528,118 B2 9/2013 Ide
8,544,118 B2 10/2013 Brine, III
8,656,520 B2 2/2014 Rush, III
8,719,967 B2 5/2014 Milsom
8,793,816 B2 8/2014 Emrich
8,813,269 B2 8/2014 Bologna
8,819,871 B2 9/2014 Maddux
8,850,622 B2 10/2014 Finiel
8,887,312 B2 11/2014 Bhatnagar
8,927,088 B2 1/2015 Faden
8,938,818 B2 1/2015 Ide
8,966,670 B2 3/2015 Cheng
8,966,671 B2 3/2015 Rumbaugh
8,978,167 B2 3/2015 Blair
9,107,466 B2 8/2015 Hoying
9,210,961 B2 12/2015 Torres
9,277,781 B2 3/2016 Hardy
9,289,024 B2 3/2016 Withnall et al.
9,364,041 B2 6/2016 Chilson
9,498,014 B2 11/2016 Princip
9,511,272 B2 12/2016 Lowe
9,530,248 B2 12/2016 Zhang
9,554,611 B2 1/2017 Arrouart
9,788,591 B2 10/2017 Ide et al.
D807,587 S 1/2018 Lebel et al.
2001/0032351 A1 10/2001 Nakayama
2002/0104533 A1 8/2002 Kalhok
2002/0174480 A1 11/2002 Lombard
2003/0056279 A1 * 3/2003 Garneau ..... A42B 3/066 2/425
2003/0188375 A1 10/2003 Wilson
2003/0209241 A1 11/2003 Fournier
2004/0025231 A1 2/2004 Ide
2004/0139531 A1 7/2004 Moore, III
2004/0181854 A1 9/2004 Primrose
2005/0114975 A1 6/2005 Ide
2005/0235403 A1 10/2005 Ide
2005/0278835 A1 12/2005 Ide
2006/0031978 A1 2/2006 Pierce
2006/0038694 A1 2/2006 Naunheim
2006/0059606 A1 * 3/2006 Ferrara ..... A01N 25/18 2/412
2006/0112477 A1 6/2006 Schneider
2006/0143807 A1 * 7/2006 Udelhofen ..... A63B 71/10 2/425
2007/0151003 A1 7/2007 Shih
2007/0157370 A1 7/2007 Joubert Des Ouches
2007/0163158 A1 7/2007 Bentz
2007/0192944 A1 8/2007 Ide
2008/0052808 A1 3/2008 Leick
2008/0163410 A1 7/2008 Udelhofen
2008/0250550 A1 10/2008 Bologna
2008/0256686 A1 10/2008 Ferrara
2008/0295228 A1 * 12/2008 Muskovitz ..... A42B 3/283 2/412
2009/0044316 A1 * 2/2009 Udelhofen ..... A42B 3/20 2/424
2009/0106882 A1 * 4/2009 Nimmons ..... A42B 3/20 2/414
2009/0178184 A1 7/2009 Brine, III et al.
2009/0260133 A1 10/2009 Del Rosario
2009/0265841 A1 10/2009 Ferrara
2010/0005573 A1 * 1/2010 Rudd ..... A42B 3/062 2/414
2011/0203038 A1 8/2011 Jones, Jr.
2011/0209272 A1 9/2011 Drake
2011/0214224 A1 9/2011 Maddux et al.
2011/0225706 A1 9/2011 Pye
2011/0271428 A1 11/2011 Withnall
2011/0277221 A1 11/2011 Ide
2012/0011639 A1 1/2012 Beauchamp
2012/0036619 A1 2/2012 Ytterborn
2012/0060251 A1 3/2012 Schimpf
2012/0079646 A1 4/2012 Belanger
2013/0333098 A1 12/2013 Nimmons
2013/0340146 A1 12/2013 Dekker
2014/0007327 A1 1/2014 Ide
2014/0150169 A1 6/2014 Ide
2015/0135414 A1 5/2015 Ide

FOREIGN PATENT DOCUMENTS

DE 8321097 10/1983
DE 3338188 5/1985
DE 3603234 8/1987
DE 3632525 8/1996
DE 19745960 10/1997
EP 512193 11/1992
FR 1528113 6/1968
GB 256430 8/1926
GB 1354719 6/1974
JP 56-53735 5/1981
JP 57-205511 12/1982
JP 6159631 4/1986
JP 3-22024 3/1991
JP 05-132809 5/1993

(56) References Cited

FOREIGN PATENT DOCUMENTS

| | | |
|---|---|---|
| JP | 5-72922 U | 10/1993 |
| JP | 199421667 | 3/1994 |
| JP | 6010204 | 4/1994 |
| JP | 07-109609 | 4/1995 |
| JP | 07-126908 | 5/1995 |
| JP | 11189910 | 12/1997 |
| JP | 1077521 | 3/1998 |
| JP | 10-195707 | 7/1998 |
| JP | 2000265315 | 9/2000 |
| JP | 2001-020121 | 1/2001 |
| JP | 20013220 | 1/2001 |
| JP | 2002161426 | 6/2002 |
| JP | 59-37323 | 9/2011 |
| WO | 9534229 | 12/1995 |
| WO | 1995034229 | 12/1995 |
| WO | 9911152 | 3/1999 |
| WO | 9956572 | 11/1999 |
| WO | 0152676 | 7/2001 |

OTHER PUBLICATIONS

Face-Off Lacrosse Yearbook 2003, Spring 2003, vol. 10 (3 pages).
Four Photographs of Riddell, Inc.'s VSR4 football helmet which was commercially available prior to May 1, 2001.
Newman, James, "A New Biochemical Assessment of Mild Traumatic Brain Injury Part 2—Results and Communications", published prior to (critical date) Sep. 8, 2005 (Abstract only).
Schutt Photographs (Published Apr. 2001) (Exhibit 1 of Irvin Declaration).
U.S. Appl. No. 10/151,245, filed May 21, 2002, Lombard.
Claim Construction Opinion and Order; *Riddell, Inc.* v. *Schutt Sports, Inc.*; U.S. District Court for the W.D. of Wisconsin; 08-cv-711; dated Jul. 10, 2009.
Decision, Institution of Inter Partes Review 37 C.F.R. 42.108, Entered Feb. 10, 2017, Case IPR2016-01649, U.S. Pat. No. 8,813,269 B2 (33 Pages).
Declaration of co-inventor Thad M. Ide, dated Oct. 28, 2004, 2 pages, with photographs of seven (7) helmets bearing labels A1-A6, B1-B5, C1-7, D1-D5, E1-E5, F1-F5, G1-G5, 22 pages, (commercially available prior to Apr. 29, 2003) see p. 2 of declaration.
Declaration of Michael W. Irvin dated Aug. 30, 2012.
Expert Report of Mr. Rovani filed Dec. 15, 2009, *Riddell, Inc.* v *Schutt Sports, Inc.*; U.S. District Court for the W.D. of Wisconsin; 08-cv-711.
Newman, James A., "A Proposed New Biochemical Head Injury Assessment Funcation—The Maximum Power Index", Stapp Paper No. OOS-80, 44th Stapp Car Crash Conference Proceedings—Copyright 2000 The Staff Association; published prior to (critical date) Sep. 8, 2005 (Abstract only).
Newman, James, "A New Biochemical Assessment of Mild Traumatic Brain Injury Part 1—Methodology", published prior to (critical date) Sep. 8, 2005 (Abstract only).
Patent Owner's Preliminary Response, Case No. IPR2016-01649, U.S. Pat. No. 8,813,269 (61 Pages).
Petition for Inter Partes Review of U.S. Pat. No. 8,813,269 filed Aug. 19, 2016 (90 Pages).
Plaintiff Riddell's Brief in Support of Proposed Claim Constructions; dated Apr. 29, 2009.
Plaintiff Riddell's Opinion Brief to Defendant Schutt's Proposed Claim Constructions; dated May 18, 2009.
Rawlings Fall/Winter Sports Catalog 1926-1927.
Schutt Sports, 2002 Football Catalog (Exhibit 2 of Irvin Declaration).
Schutt's Answer and Affirmative Defenses; *Riddell, Inc.* v. *Schutt Sports, Inc.*; U.S. District Court for the W.D. of Wisconsin; 08-cv-711; dated Feb. 16, 2009.
Schutt's Response to Riddell's First Set of Interrogatories; including patent invalidity contentions and exhibit with invalidity claim charts; dated Mar. 13, 2009.
Supplemental Declaration of Michael W. Irvin Under 37 CFR 1.132 and MPEP 2616 Dated Dec. 27, 2012.
Wilson Trade Price Edition Fall and Winter 1964 Catalog (152 pages).
Wilson Trade Price Edition 1953 Football Catalog (56 pages).
Wilson Trade Price Edition 1952-1953 Football Catalog (100 pages).
Wilson Sporting Goods Company Fall and Winter 1976 Catalog (28 pages).
Wilson Sporting Goods Company Fall and Winter 1972 Catalog (88 pages).
Virgina Tech, Adult Football Helmet Detailed Ratings (May 2011).
Stall & Dean Fall and Winter Catalog 1960-1961 (72 pages).
Sports Review Football 1954, Rawlings HC20 and TH24 Helmet (2 pages).
Sears Wish Book for the 1971 Christmas Season Catalog (11 pages).
Sears Fall and Winter Catalog 1966 (2 pages).
Sears Fall and Winter Catalog 1963 (2 pages).
Sears Fall and Winter 1968 Catalog T-Bar Helmet (4 pages).
Sears Catalog, Cycolac Plastic Helmet (2 pages).
Schutt 2009 Football Quick Guide (12 pages).
Schutt 2009 Football Catalog (32 pages).
Schutt 2007 ION 4D Information Sheet (2 pages).
Schutt 2005 Fitting Guide (32 pages).
Schutt 2001 Football Catalog (46 pages).
Scholastic Coach, MacGregor E700 Helmet, Jan. 1959 (2 pages).
Robert Smith, Illustrated History of Pro Football (1970), cover illustration.
Riddell Team Tested Tuff Catalog (31 pages).
Riddell Institutional Football Catalog (33 pages).
Riddell Inc., Screenshots of http://www.riddell.com/history, captured Feb. 20, 2014.
Riddell Bio Lite Helmet, 1988 ( 3 pages).
Riddell 2010 Speed Fitting Guide (4 pages).
Riddell 2010 Football Catalog (140 pages).
Riddell 2009 Football Catalog (132 pages).
Riddell 2007 Football Catalog (108 pages).
Riddell 2007 Catalog (192 pages).
Riddell 2006 Football Catalog (84 pages).
Riddell 2006 Catalog (160 pages).
Riddell 2005 Catalog (164 pages).
Riddell 2004 Football Catalog (88 pages).
Riddell 2003 Football Catalog (92 pages).
Riddell 2002 Football Catalog (88 pages).
Riddell 2001 Football Catalog (94 pages).
Riddell 2001 Baseball Catalog (79 pages).
Riddell 2000 Football Catalog (76 pages).
Riddell 2000 Baseball Catalog (52 pages).
Riddell 1998-1999 Football Catalog (72 pages).
Riddell 1998 Football Air Catalog (16 pages).
Riddell 1997-1998 Football Catalog (55 pages).
Riddell 1996-1997 Football Catalog (40 pages).
Riddell 1996-1997 Baseball and Softball Catalog (24 pages).
Riddell 1995 Factory Direct Savings Catalog (22 pages).
Riddell 1994 Football Catalog (20 pages).
Riddell 1993 Product Catalog (12 pages).
Riddell 1993 Football Catalog (32 pages).
Riddell 1992 Catalog (40 pages).
Riddell 1991 Catalog (11 pages).
Riddell 1990 Football Catalog (32 pages).
Riddell 1989 Football Catalog (24 pages).
Riddell 1989 Football Air Catalog (16 pages).
Riddell 1988 Equipment Catalog (24 pages).
Riddell 1987 Equipment Catalog (24 pages).
Riddell 1986 Equipment Catalog (24 pages).
Riddell 1985 Equipment Catalog (32 pages).
Riddell 1984 Equipment Catalog (29 pages).
Riddell 1983 Equipment Catalog (34 pages).
Riddell 1980 Equipment Catalog (16 pages).
Riddell 1979 Equipment Catalog (23 pages).
Riddell 1978 Equipment Catalog (24 pages).
Riddell 1977 Equipment Catalog (24 pages).
Riddell 1976 Equipment Catalog (20 pages).
Riddell 1975 Equipment Catalog (19 pages).

(56) References Cited

OTHER PUBLICATIONS

Riddell 1974 Equipment Catalog (18 pages).
Riddell 1973 Equipment Catalog (11 pages).
Riddell 1972 Equipment Catalog (14 pages).
Riddell 1970 Equipment Catalog (18 pages).
Riddell 1969 Equipment Catalog (14 pages).
Riddell 1967 Football Equipment Catalog (16 pages).
Replacement Comments by Third-party Requester Pursuant to 35 U.S.C 314(b)(2) and 37 cfr 1.947 in Control No. 95/002,117.
Rawlings Catalog Fall and Winter Retail Sher-wood Adirondack 1975 (28 pages).
Rawlings Catalog Fall and Winter Institutional 1971 (92 pages).
Rawlings Catalog Fall and Winter Equipment and Clothing 1981 (68 pages).
Rawlings Catalog Fall and Winter Athletic Equipment 1964 (76 pages).
Rawlings Catalog Fall and Winter Athletic Equipment 1963 (72 pages).
Rawlings Catalog Fall and Winter Athletic Equipment 1959-1960 (84 pages).
Rawlings Catalog Fall and Winter Athletic Equipment 1957-1958 (82 pages).
Rawlings Catalog Fall and Winter Athletic Equipment 1955-1956 (83 pages).
Rawlings Advance Football and Basketball Catalog 1957 (46 pages).
Rawlings 1955-56 Advance Football and Basketball Catalog (36 pages).
Photographs of 4 helmets bearing labels B1-B5, C1-C7, D1-D5, G1-G5, 13 pages, commercially available before Apr. 29, 2003.
Photographs of 3 helmets bearing labels A1-A6, E1-E5, and F1-F5, 9 pages, commercially available before May 1, 2001.
Midco Fall and Winter, H-400M Helmet, 1975 (8 pages).
Micky Collins, et al., Examining Concussion Rates and Return to Play in High School Football Players Wearing Newer Helmet Technology, 58 Neurosurgery 275 (2006).
Medalist Gladiator 1989 Fall and Winter Catalog (20 pages).
Marvel Comics, Magneto Revolution (2000), cover illustration.
MacGregor Sports Equipment Fall and Winter 1959 (84 pages).
Kranos Corp.'s random collection of select catalog images, undated, (76 pages).
J.A. Dubow Sporting Goods Corp., The Choice of Champions Serving the Sporting Goods Industry for Over 4 Decades 1912-1961 (32 pages).
Hutch Catalog 1976 (40 pages).
Great Atlantic C Lacrosse Company, Feb. 2000 (1 page).
GB Lax Gait Brothers Lacrosse Magazine 2002 (24 pages).
Declaration of Thad M. Ide Under 37 CFR 1.131 (with Exhibits A-G) in Control No. 95/002,117.
David Bushing, Sports Equipment Price Guide (1995), pp. 236-238, 240-241, 243-244, 263.
Bike Football Catalog 2002 (6 pages (includes 3 additional pages)).
Bike Football Catalog 2002 (3 pages).
Bike Catalog 1999 (2 pages).
Athletic Journal Catalog Excerpt, vol. 65, No. 7, Mar. 1985 (2 pages).
Athletic Journal Catalog Excerpt, vol. 59, No. 6, Feb. 1979 (3 pages).
Athletic Journal Catalog Excerpt, vol. 57, No. 4, Dec. 1976 (2 pages).
Athletic Journal Catalog Excerpt, vol. 55, No. 3, Nov. 1974 (2 pages).
Athletic Journal Catalog Excerpt, vol. 53, No. 8, Apr. 1973 (2 pages).
Athletic Journal Catalog Excerpt, vol. 51, No. 6, Feb. 1971 (2 pages).
Athletic Journal Catalog Excerpt, vol. 50, No. 8, Apr. 1970 (2 pages).
Athletic Journal Catalog Excerpt, vol. 49, No. 8, Apr. 1969 (2 pages).
Athletic Journal Catalog Excerpt, vol. 48, vol. 10, Jun. 1968 (2 pages).
Athletic Journal Catalog Excerpt, vol. 48, No. 3, Nov. 1967 (2 pages).
Athletic Journal Catalog Excerpt, vol. 46, No. 3, Nov. 1965 (2 pages).
Athletic Journal Catalog Excerpt, vol. 46, No. 10, Jun. 1966 (2 pages).
Athletic Journal Catalog Excerpt, vol. 45, No. 9, May 1965 (2 pages).
Athletic Journal Catalog Excerpt, vol. 45, No. 10, Jun. 1965 (3 pages).
Athletic Journal Catalog Excerpt, vol. 44, No. 9, May 1964 (2 pages).
Athletic Journal Catalog Excerpt, vol. 44, No. 2, Oct. 1964 (2 pages).
Athletic Journal Catalog Excerpt, vol. 44, No. 10, Jun. 1964 (2 pages).
Athletic Journal Catalog Excerpt, vol. 43, No. 8, Apr. 1963 (2 pages).
Athletic Journal Catalog Excerpt, vol. 43, No. 5, Jan. 1963 (2 pages).
Athletic Journal Catalog Excerpt, vol. 41, No. 9, May 1961 (2 pages).
Athletic Journal Catalog Excerpt, vol. 41, No. 10, Jun. 1961 (2 pages).
Athletic Journal Catalog Excerpt, vol. 40, No. 9, May 1960 (2 pages).
Athletic Journal Catalog Excerpt, vol. 40, No. 4, Dec. 1959 (2 pages).
Athletic Journal Catalog Excerpt, vol. 40, No. 10, Jun. 1960 (2 pages).
Athletic Journal Catalog Excerpt, vol. 38, No. 6, Feb. 1958 (2 pages).
Athletic Journal Catalog Excerpt, vol. 38, No. 10, Jun. 1959 (2 pages).
Athletic Journal Catalog Excerpt, vol. 37, No. 9, May 1957 (2 pages).
Athletic Journal Catalog Excerpt, vol. 37, No. 7, Mar. 1957 (2 pages).
Athletic Journal Catalog Excerpt, vol. 37, No. 6, Feb. 1957 (2 pages).
Athletic Journal Catalog Excerpt, vol. 37, No. 5, Jan. 1957 (2 pages).
Athletic Journal Catalog Excerpt, vol. 37, No. 4, Dec. 1956 (2 pages).
Athletic Journal Catalog Excerpt, vol. 37, No. 2, Oct. 1956 (2 pages).
Athletic Journal Catalog Excerpt, vol. 36, No. 8, Apr. 1956 (2 pages).
Athletic Journal Catalog Excerpt, vol. 36, No. 7, Mar. 1956 (2 pages).
Athletic Journal Catalog Excerpt, vol. 36, No. 5, Jan. 1956 (2 pages).
Athletic Journal Catalog Excerpt, vol. 35, No. 6, Feb. 1955 (2 page.
Athletic Journal Catalog Excerpt, vol. 35, No. 9, May 1955 (2 pages).
Athletic Journal Catalog Excerpt, vol. 35, No. 10, Jun. 1956 (2 pages).
Athletic Journal Catalog Excerpt, vol. 48, No. 5, Jan. 1968 (2 pages).
Athletic Journal Catalog Excerpt, vol. 36, No. 3, Nov. 1955 (2 pages).
1997 JOFA Hockey Equipment Catalog (60 pages).
Virginia Tech, Adult Football Helmet Evaluation Methodology (May 9, 2011).
The Draper Maynard Co., D&M Sporting Goods Catalog, 1925-1926.
Steven Rowson & Stefan M. Duma, Development of the STAR Evaluation System for Football Helmets, 39 Ann. of Biomedical Eng. 2130 (Aug. 2011).
Shoei Catalog 1999 (16 pages).
Screenshots from 1997 Starship Troopers Movie (12 pages).

(56) References Cited

OTHER PUBLICATIONS

Scholastic Coach, Spalding No. 100, Dec. 1950 (2 pages).
Scholastic Coach, Spalding Helmet, Mar. 1959 (2 pages).
Rawlings Catalog Fall and Winter Athletic Equipment 1949-1950 (74 pages).
Rawlings Catalog Fall and Winter Athletic Equipment 1948-1949 (2 pages).
King-O'shea Turret Tenite Helmet 1954 (1 page).
John Field, Patton of the Armored Force, Life Magazine, Nov. 30, 1942.
Easton Bell Sports, Riddell Fact Sheet.
Declaration of Dr. James Newman under 37 CFR 1.132 in Control No. 95/002,117.
Declaration of Allison Boersma Under 37 CFR 1.132 in Control No. 95/002,117.
Athletic Journal Catalog Excerpt, vol. 61, No. 4, Dec. 1980 (2 pages).
Athletic Journal Catalog Excerpt, vol. 60, No. 8, Apr. 1980 (2 pages).
Athletic Journal Catalog Excerpt, vol. 57, No. 5, Jan. 1977 (6 pages).
Athletic Journal Catalog Excerpt, vol. 56, No. 5, Jan. 1976 (6 pages).
Athletic Journal Catalog Excerpt, vol. 49, No. 10, Jun. 1969 (2 pages).
Athletic Journal Catalog Excerpt, vol. 47, No. 3, Nov. 1966 (2 pages).
Athletic Journal Catalog Excerpt, vol. 36, No. 6, Feb. 1956 (2 pages).
Athletic Journal Catalog Excerpt, vol. 34, No. 7, Mar. 1954 (2 pages).
Athletic Journal Catalog Excerpt, vol. 34, No. 10, Jun. 1954 (2 pages).
Athletic Journal Catalog Excerpt, vol. 33, No. 9, May 1953 (2 pages).
Athletic Journal Catalog Excerpt, vol. 33, No. 8, Apr. 1953 (2 pages).
Athletic Journal Catalog Excerpt, vol. 32, No. 7, Mar. 1952 (2 pages).
Athletic Journal Catalog Excerpt, vol. 32, No. 6, Feb. 1952 (2 pages).
Athletic Journal Catalog Excerpt, vol. 32, No. 2, Oct. 1951 (2 pages).
Athletic Journal Catalog Excerpt, vol. 32, No. 10, Jun. 1952 (2 pages).
Athletic Journal Catalog Excerpt, vol. 31, vol. 6, Feb. 1951 (2 pages).
Athletic Journal Catalog Excerpt, vol. 31, No. 7, Mar. 1951 (2 pages).
Athletic Journal Catalog Excerpt, vol. 31, No. 4, Dec. 1950 (2 pages).
Athletic Journal Catalog Excerpt, vol. 31, No. 10, Jun. 1951 (2 pages).
Athletic Journal Catalog Excerpt, vol. 30, vol. 6, Feb. 1950 (2 pages).
Athletic Journal Catalog Excerpt, vol. 30, No. 9, May 1950 (2 pages).
Athletic Journal Catalog Excerpt, vol. 30, No. 7, Mar. 1950 (2 pages).
Athletic Journal Catalog Excerpt, vol. 30, No. 4, Dec. 1949 (2 pages).
Athletic Journal Catalog Excerpt, MacGregor E700 Helmet, Jan. 1959 (1 page).
Schutt Final Invalidity Contentions Cover Document (104 pages).
Schutt's Final Invalidity Contentions Exhibit A '818 Patent (904 pages).
Schutt's Final Invalidity Contentions Exhibit AB1—Alternate Combos Under 103—Ear Openings (29 pages).
Schutt's Final Invalidity Contentions Exhibit AB2—Alternate Combos Under 103—Raised Central Band (58 pages).
Schutt's Final Invalidity Contentions Exhibit AB3—Alternate Combos Under 103—Vent Openings (47 pages).
Schutt's Final Invalidity Contentions Exhibit AB4—Alternate Combos Under 103—Chin Strap (31 pages).
Schutt's Final Invalidity Contentions Exhibit AB5—Alternate Combos Under 103—Face Guard (32 pages).
Schutt's Final Invalidity Contentions Exhibit AB6—Alternate Combos Under 103—Offset Band (11 pages).
Schutt's Final Invalidity Contentions Exhibit AB7—Alternate Combos Under 103—Inflation (21 pages).
Schutt's Final Invalidity Contentions Exhibit B '118 Patent (415 pages).
Xenith's Final Invalidity Contentions—Cover Pleading (31 pages).
Xenith's Invalidity Contentions C1-C11 818 chart (341 pages).
Xenith's Invalidity Contentions D1-D11 118 chart (457 pages).
Claim Construction Order, Case 1:16-cv-04496 (39 pages).
Final Written Decision, 35 U.S.C. § 318(a) and 37 C.F.R. § 42.73, *Kranos Corporation* v. *Riddell, Inc.*, Entered Feb. 21, 2018, Case No. IPR2016-01650, U.S. Pat. No. 8,938,818 B2 (47 pages).
Final Written Decision, 35 U.S.C. § 318(a) and 37 C.F.R. § 42.73, *Kranos Corporation* v. *Riddell, Inc.*, Entered Feb. 5, 2018, Case No. IPR2016-01646, U.S. Pat. No. 8,528,118 C1 (84 pages).
Kranos Corp. d/b/a Schutt Sports' Expert Report of Dr. Posner (including Exhibits C-R); *Riddell Inc.* v. *Kranos Corp.*, N.D. IL, case 1:16-cv-04496 (686 pages).
Riddell Inc.'s Responsive Expert Report of Mr. Shewchenko; *Riddell Inc.* v. *Kranos Corp.*, N.D. IL, case 1:16-cv-04496 (142 pages).
Decision Denying Petitioner's Request for Rehearing regarding Non-Instituted Claims of U.S. Pat. No. 8,528,118, Case No. IPR2016-01646 (17 pages).
Decision to Institute Inter Partes Review of Certain Claims of U.S. Pat. No. 8,938,818, Case No. IPR2016-01650 (36 pages).
Declaration of Kyle C. Borland (with Exhibits A-G), Dated Apr. 28, 2016, Inter Partes Reexamination Control No. 95/002,117 (57 pages).
Declaration of Larry Maddux, Dated Feb. 19, 2014, Inter Partes Reexamination Control No. 95/002,117 (6 pages).
Declaration of Nelson Kraemer (with Exhibits A-J), Dated Apr. 29, 2016, Inter Partes Reexamination Control No. 95/002,117 (37 pages).
Declaration of Nicholas Shewchenko in Support of Riddell Opposition to Schutt's Motion for Partial Summary Judgment of U.S. Pat. No. 8,939,818, Case 1:16-cv-04496 (18 pages).
Declaration of Patent Owner's Expert, Nicholas Shewchenko, Case Nos. IPR2016-01649 (U.S. Pat. No. 8,813,269), IPR2016-01646 (U.S. Pat. No. 8,528,118), and IPR2016-1650 (U.S. Pat. No. 8,938,818) (52 pages).
Declaration of Petitioner's Expert, Bernard Daoust, U.S. Pat. No. 8,528,118, Case No. IPR2016-01316 (42 pages).
Declaration of Petitioner's Expert, Bernard Daoust, U.S. Pat. No. 8,938,818 (48 pages).
Declaration of Petitioner's Expert, Jamison Float, U.S. Pat. No. 8,528,118, Case No. IPR2016-01646 (28 pages).
Declaration of Petitioner's Expert, Jamison Float, U.S. Pat. No. 8,938,818, Case No. IPR2016-01530 (47 pages).
Declaration of Petitioner's Expert, Jamison Float, U.S. Pat. No. 8,938,818, Case No. IPR2016-01650 (45 pages).
Declaration of Wayne Lawrence (with Exhibits A-G), Dated Apr. 28, 2016, Inter Partes Reexamination Control No. 95/002,117 (36 pages).
Deposition of Patent Owner's Expert, Nicholas Shewchenko, Case Nos. IPR2011649 (U.S. Pat. No. 8,813,269), IPR2016-01646 (U.S. Pat. No. 8,528,118), and IPR2016-1650 (U.S. Pat. No. 8,938,818) (192 pages).
Deposition of Petitioner's Expert, Jamison Float, Case Nos. IPR2016-01649 (U.S. Pat. No. 8,813,269), IPR2016-01646 (U.S. Pat. No. 8,528,118), and IPR2016-1650 (U.S. Pat. No. 8,938,818) (99 pages).
Examiner's Determination regarding New Ground of Rejection, Dated Oct. 24, 2016, Inter Partes Reexamination Control No. 95/002,117 (10 pages).
Order Denying Defendant's Motion for Partial Summary Judgment of U.S. Pat. No. 8,938,818, Case 1:16-cv-04496 (12 pages).

(56) References Cited

OTHER PUBLICATIONS

Patent Trial and Appeal Board's Decision regarding Examiner's Determination on New Ground of Rejection, Dated Jun. 22, 2917, Inter Partes Reexamination Control No. 95/002,117 (24 pages).
Patent Trial and Appeal Board's Order Remanding Inter Partes Reexamination to the Examiner, Dated Aug. 23, 2016, Inter Partes Reexamination Control No. 95/002,117 (4 pages).
Second Supplemental Declaration of Thad M. Ide (with Exhibits A-N), Dated Apr. 28, 2016, Inter Partes Reexamination Control No. 95/002,117 (68 pages).
Supplemental Declaration of Thad M. Ide (with Exhibits A-D), Dated Jan. 21, 2014, Inter Partes Reexamination Control No. 95/002,117 (16 pages).
Decision, Institution of Inter Partes Review 37 C.F.R. § 42.108, Entered Feb. 14, 2017, Case No. IPR2016-01646, U.S. Pat. No. 8,528,118 (72 pages).
Decision, Institution of Inter Partes Review 37 C.F.R. § 42.108, Entered Feb. 22, 2017, Case No. IPR2016-01650, U.S. Pat. No. 8,938,818 (36 pages).
Petition for Inter Partes Review of U.S. Pat. No. 8,938,818 filed Aug. 19, 2016 (142 pages).
Patent Owner's Preliminary Response, Case No. IPR2016-01650, U.S. Pat. No. 8,938,818 (71 pages).
Petition for Inter Partes Review of U.S. Pat. No. 8,528,118 filed Aug. 19, 2016 (76 pages).
Patent Owner's Preliminary Response, Case No. IPR2016-01646, U.S. Pat. No. 8,528,118 (66 pages).
Kranos Exhibit 1015 filed in Petition for Inter Partes Review of U.S. Pat. No. 8,938,818 filed Aug. 19, 2016 (4 pages).
Schutt's Opening Claim Construction Brief, Case 1:16-cv-04496 (51 pages).
Xenith's Opening Claim Construction Brief, Case 1:16-cv-04496 (35 pages).
Riddell's Response to Schutt's Opening Claim Construction Brief, Case 1:16-cv-04496 (33 pages).
Riddell's Response to Xenith's Opening Claim Construction Brief, Case 1:16-cv-04496 (31 pages).
Schutt's Reply Claim Construction Brief, Case 1:16-cv-04496 (18 pages).
Xenith's Reply Claim Construction Brief, Case 1:16-cv-04496 (16 pages).
Joint Claim Construction Chart, Case 1:16-cv-04496 (9 pages).
Schutt's Motion for Partial Summary Judgment of U.S. Pat. No. 8,938,818, Case 1:16-cv-04496 (22 pages).
Local Rule 56.1 Statement of Material Facts in Support of Schutt's Motion for Partial Summary Judgment of U.S. Pat. No. 8,938,818, Case 1:16-cv-04496 (27 pages).
Riddell Opposition to Schutt's Motion for Partial Summary Judgment of U.S. Pat. No. 8,939,818, Case 1:16-cv-04496 (21 pages).
Riddell's Response to Schutt's Local Rule 56.1 Statement of Material Facts in Support of Schutt's Motion for Partial Summary Judgment and Riddell's Statement of Additional Facts that Require Denial of Summary Judgment of U.S. Pat. No. 8,938,818, Case 1:16-cv-04496 (52 pages).
Schutt's Reply in Support of its Motion for Partial Summary Judgment of U.S. Pat. No. 8,938,818, Case 1:16-cv-04496 (22 pages).
Schutt's Response to Riddell's Local Rule 56.1 Statement of Material Facts in Opposition to Schutt's Motion for Partial Summary Judgment of U.S. Pat. No. 8,938,818, Case 1:16-cv-04496 (19 pages).
Invalidity Chart of U.S. Pat. No. 8,938,818 in Light of Revolution Speed Fitting Guide, Published 2010, Case No. IPR2016-01650 (47 pages).
Invalidity Chart of U.S. Pat. No. 8,938,818 in Light of the Wish Book for the 1971 Christmas Season Catalog, et al., Case No. IPR2016-01650 (66 pages).
Invalidity Chart of U.S. Pat. No. 8,938,818 in Light of U.S. Pat. No. 3,729,744 to Rappleyea et al., Case No. IPR2016-01650 (57 pages).
Invalidity Chart of U.S. Pat. No. 8,938,818 in Light of U.S. Pat. No. 5,732,414 to Monica, et al., Case No. IPR2016-01650 (34 pages).
Patent Owner's Response to the Decision to Institute Inter Partes Review of Certain Claims of U.S. Pat. No. 8,938,818, Case No. IPR2016-01650 (50 pages).
Petitioner's Reply Brief in Support of Its Petition for Inter Partes Review of U.S. Pat. No. 8,938,818, Case No. IPR2016-01650 (29 pages).
Petition for Inter Partes Review of U.S. Pat. No. 8,938,818, Case No. IPR2016-01530 (116 pages).
Invalidity Chart of U.S. Pat. No. 8,938,818 in Light of U.S. Publication No. 2011/0271428 to Withnall, et al., Case No. IPR2016-01530 (53 pages).
Invalidity Chart of U.S. Pat. No. 8,938,818 in Light of U.S. Pat. No. D. 511,026 to Ide, et al., Case No. IPR2016-01530 (47 pages).
Invalidity Chart of U.S. Pat. No. 8,938,818 in Light of U.S. Pat. No. 6,219,850 to Halstead, et al., Case No. IPR2016-01530 (37 pages).
Patent Owner's Preliminary Response, U.S. Pat. No. 8,938,818, Case No. IPR2016-01530 (77 pages).
Petition for Inter Partes Review of U.S. Pat. No. 8,938,818, Case No. IPR2016-01317 (80 pages).
Invalidity Chart of U.S. Pat. No. 8,938,818 in Light of the Wish Book for the 1971 Christmas Season Catalog, et al., Case No. IPR2016-01317 (47 pages).
Invalidity Chart of U.S. Pat. No. 8,938,818 in Light of U.S. Pat. No. 3,729,744 to Rappleyea et al., Case No. IPR2016-01317 (40 pages).
Invalidity Chart of U.S. Pat. No. 8,938,818 in Light of U.S. Pat. No. 5,732,414 to Monica, et al., Case No. IPR2016-01317 (39 pages).
Patent Owner's Preliminary Response, U.S. Pat. No. 8,938,818, Case No. IPR2016-01317, (7 pages).
Decision Granting Joint Motion to Terminate Proceeding, U.S. Pat. No. 8,938,818, Case No. IPR2016-01317 (4 pages).
Invalidity Chart of U.S. Pat. No. 8,528,118 in Light of the Wish Book for the 1971 Christmas Season Catalog, et al., Case No. IPR2016-01646 (24 pages).
Invalidity Chart of U.S. Pat. No. 8,528,118 in Light of U.S. Pat. No. 3,729,744 to Rappleyea, et al., Case No. IPR2016-01646 (26 pages).
Invalidity Chart of U.S. Pat. No. 8,528,118 in Light of U.S. Pat. No. 2,525,389 to Zeller, Case No. IPR2016-01646 (13 pages).
Invalidity Chart of U.S. Pat. No. 8,528,118 in Light of U.S. Pat. No. 6,219,850 to Halstead, et al., Case No. IPR2016-01646 (21 pages).
Invalidity Chart of U.S. Pat. No. 8,528,118 in Light of U.S. Pat. No. 5,732,414 to Monica, et al., Case No. IPR2016-01646 (14 pages).
Petitioner's Request for Rehearing regarding Non-Instituted Claims of U.S. Pat. No. 8,528,118, Case No. IPR2016-01646 (20 pages).
Patent Owner's Response to the Decision to Institute Inter Partes Review of Certain Claims of U.S. Pat. No. 8,528,118, Case No. IPR2016-01646 (47 pages).
Petitioner's Reply Brief in Support of Its Petition for Inter Partes Review of U.S. Pat. No. 8,528,118, Case No. IPR2016-01646 (34 pages).
Petition for Inter Partes Review of U.S. Pat. No. 8,528,118, Case No. IPR2016-01316 (91 pages).
Invalidity Chart of U.S. Pat. No. 8,528,118 in Light of the Wish Book for the 1971 Christmas Season Catalog, et al., Case No. IPR2016-01316 (32 pages).
Invalidity Chart of U.S. Pat. No. 8,528,118 in Light of U.S. Pat. No. 3,729,744 to Rappleyea et al., Case No. IPR2016-01316 (21 pages).
Invalidity Chart of U.S. Pat. No. 8,528,118 in Light of U.S. Pat. No. 5,732,414 to Monica, et al., Case No. IPR2016-01316 (23 pages).
Patent Owner's Preliminary Response, U.S. Pat. No. 8,528,118, Case No. IPR2016-01316 (6 pages).
Decision Granting Joint Motion to Terminate Proceeding, U.S. Pat. No. 8,528,118, Case No. IPR2016-01316 (4 pages).

* cited by examiner

PROTECTIVE SPORTS HELMET

CROSS-REFERENCE TO RELATED APPLICATIONS

This Application is a continuation of pending U.S. patent application Ser. No. 15/076,106, filed on Mar. 21, 2016, which is a continuation of U.S. patent application Ser. No. 13/068,104, filed on May 2, 2011, now U.S. Pat. No. 9,289,024, which is a continuation-in-part of U.S. patent application Ser. No. 12/082,920, filed on Apr. 15, 2008, now U.S. Pat. No. 8,813,269, which claims the benefit of Provisional Patent Application No. 60/923,603, filed on Apr. 16, 2007, and which also claims the benefit of Provisional Patent Application No. 61/343,567, filed on Apr. 30, 2010, all of these applications which are incorporated herein by reference and made a part hereof.

FEDERALLY SPONSORED RESEARCH OR DEVELOPMENT

N/A

TECHNICAL FIELD

The invention generally relates to a protective sports helmet, such as a football, lacrosse, hockey or baseball helmet, worn by a player during the play of a contact sport. The inventive helmet includes a number of improvements, including but not limited to an energy attenuating faceguard mounting system that reduces impact forces received by a faceguard secured to the helmet.

BACKGROUND OF THE INVENTION

Helmets for contact sports, such as those used in football, hockey and lacrosse, typically include a shell, an internal padding assembly, a faceguard or face mask, and a chin protector or strap that removably secures the helmet on the wearer's head. The faceguard is rigidly secured to the shell by a plurality of connectors, whereby the faceguard can sustain a number of impacts during the course of play while remaining connected to the shell. Most faceguards include a plurality of intersecting and/or overlapping bars that form openings through which the wearer views the field of play. With conventional helmets, the upper faceguard bars directly contact the lower frontal portion of the helmet shell, which is referred to as the "brow region" of the shell. This direct contact results from the use of a pair of connectors secured to the brow region of the helmet shell. Additional connectors are employed to secure the faceguard to the side portions of the helmet shell. Conventional faceguard connectors are purposely designed to avoid flexing when the faceguard receives an impact force.

One existing faceguard connector is a plastic U-shaped strap member that has a receiver portion that encircles a bar of the faceguard. This strap connector includes a tab portion, wherein a threaded fastener, such as a screw, extends through the tab portion and into the shell to secure the connector and the faceguard to the helmet. Typically, these U-shaped strap connectors are found above the brow region of the shell and along each ear flap to join the faceguard to the shell. A second existing faceguard connector is disclosed in U.S. Pat. No. 6,934,971, which is owned by Riddell Inc., the assignee of the present application. That connector, marketed under the Isolator System brand name, includes a nut, a bushing, a grommet, a rectangular bracket and a threaded fastener (screw). The bracket includes a first channel that receives a first bar of the faceguard and a second channel that receives a second bar, wherein the faceguard bars are positioned between the shell and the bracket. The fastener extends through the bracket and the shell and is received by the nut (residing within the shell) to couple the faceguard to the shell. The threaded fastener is employed to secure the connector to the shell and as a result, a rotational force is applied to tighten for securement and loosen the fastener to permit removal of the bracket and faceguard. While such conventional faceguard connectors provide a number of benefits, they nevertheless have certain limitations. For example, adjusting and/or removing the faceguard from the shell can be difficult and time consuming. Because a threaded fastener is utilized, rotation of a flat-blade or Phillips screwdriver is required to loosen the fastener to allow for removal of the bracket and the faceguard. Removal of a faceguard becomes necessary when the player is injured or the player's faceguard is damaged and involves unscrewing the fastener to allow for removal of both the connector and the damaged faceguard. After the damaged faceguard is removed, a replacement faceguard is secured to the helmet with the fastener and connector. This removal and replacement process is time consuming and requires that the player having the damaged equipment to be removed from play until the process is completed. The unavailability of the player to participate in further play is detrimental to the team, especially if the player plays an essential position such as quarterback.

One additional limitation of the use of a faceguard connector above the brow region of the shell is the transmission of faceguard impact forces. Because the faceguard is in direct contact with the shell, a significant extent of a faceguard impact force is transmitted from the faceguard to the shell. Depending upon its severity and magnitude, an extent of the impact force may be transmitted through the internal padding assembly to the wearer of the helmet.

The present invention is provided to solve these limitations and to provide advantages and aspects not provided by conventional sports helmets. A full discussion of the features and advantages of the present invention is deferred to the following detailed description, which proceeds with reference to the accompanying drawings.

SUMMARY OF THE INVENTION

The present invention is directed to a protective sports helmet that includes a number of improvements intending to increase the protective nature of the helmet. For example, the helmet features an energy attenuating faceguard mounting system, which includes at least one connector that secures the faceguard (or face mask) to the helmet shell without a connection point to the shell's brow region. The lack of a brow region connection point results in a gap or clearance between the faceguard and the shell that has a functional interplay with the connector upon an impact to the faceguard.

While it is the desire and goal that a football helmet, and other types of protective helmets, prevent injuries from occurring, it should be noted that as to the helmet of the present invention, as well as prior art helmets, due to the nature of contact sports (including football), no protective equipment or helmet can completely prevent injuries to those individuals playing sports. It should be further noted that no protective equipment can completely prevent injuries to a player, especially when the player uses the equipment improperly and/or employs poor form or technique. For example, if the football player uses his football helmet in an improper manner, such as to butt, ram, or spear an opposing player, which is in violation of the rules of football and severe head and/or neck injuries, paralysis, or death to the football player, as well as possible injury to the football player's opponent can result. No football helmet, or protective helmet, such as that of the present invention, can prevent head, chin, or neck injuries a football player might receive while participating in the sport of football. The helmet of the present invention is believed to offer protection to football players, but it is believed that no helmet can, or will ever completely prevent head injuries to football players.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

Figure 1:
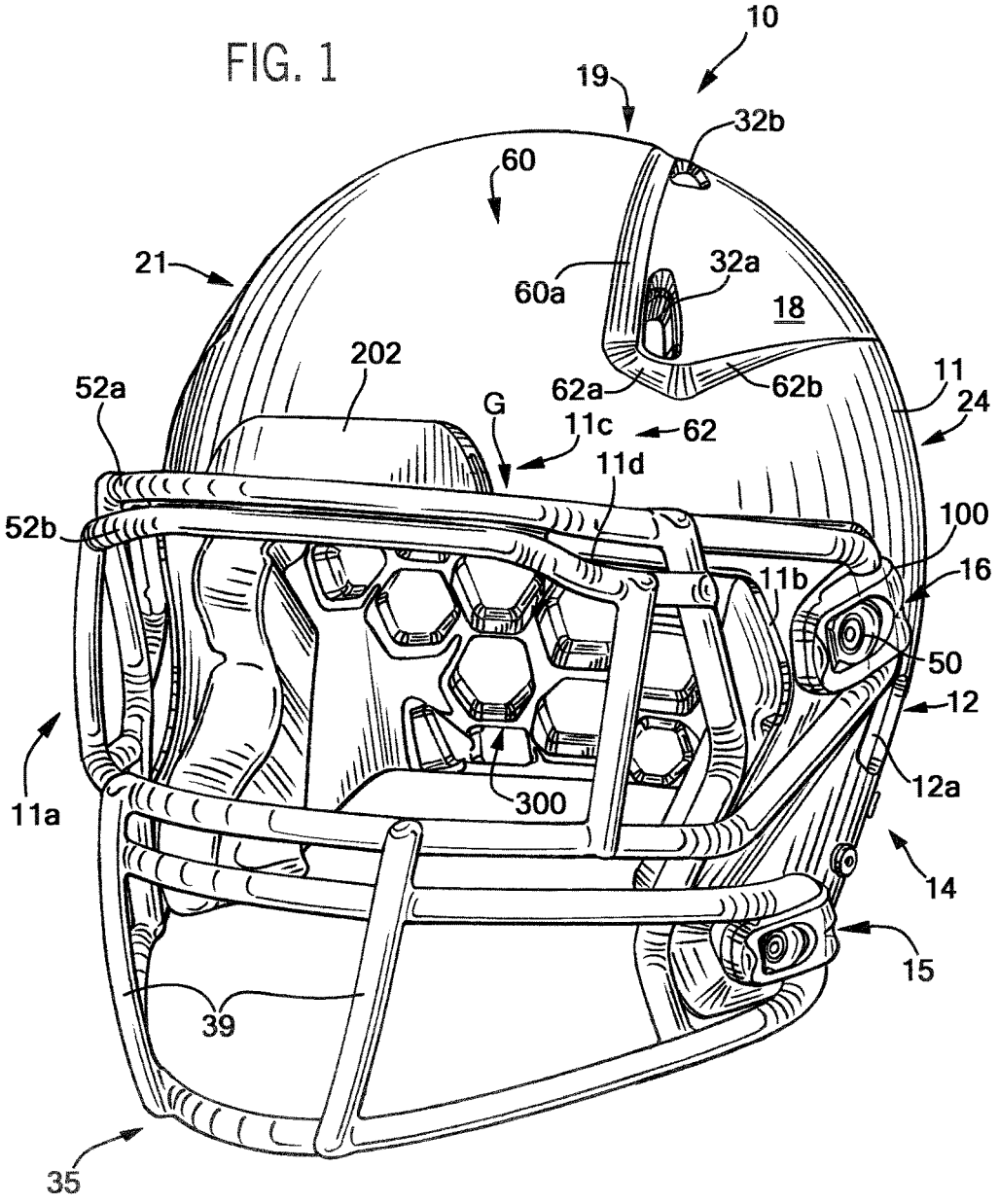
FIG. 1 is a perspective view of an embodiment of a sports helmet having an energy attenuating system of the invention, the system including a faceguard and a dynamic faceguard connector assembly.

While the invention will be described in connection with the preferred embodiments shown herein, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 13:
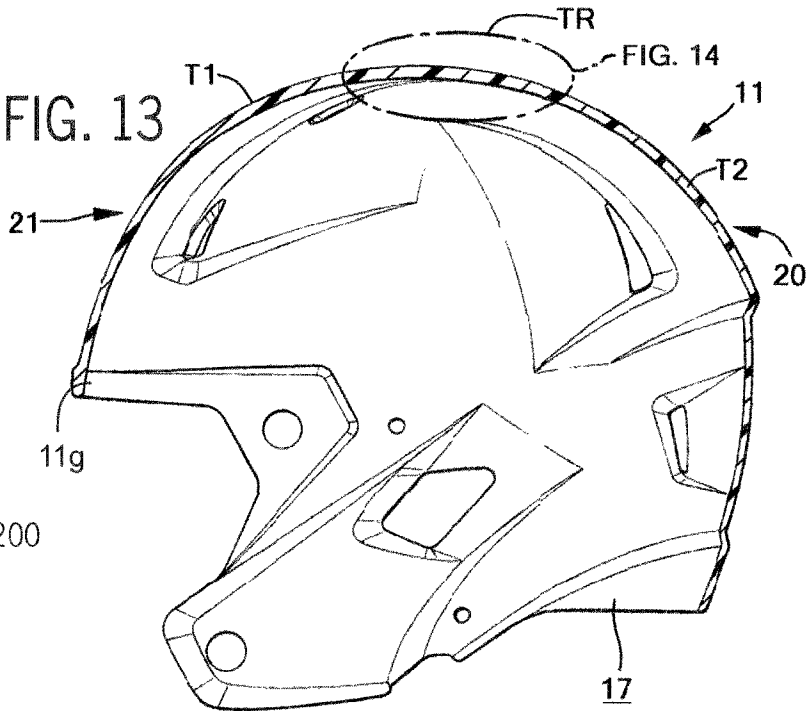
FIG. 13 is a cross-sectional view of the shell portion of the helmet taken through line 13-13 of FIG. 12.

In the Figures, a football helmet 10 in accordance with the present invention is shown to generally include: an outer shell 11 with an ear flap 12 and a jaw flap 13, an energy attenuating faceguard mounting system 14 comprising a faceguard 35 that spans a frontal shell opening 11*a* and at least one dynamic faceguard connector 16, and an internal padding assembly 300. The outer shell 11 includes a frontal opening 11*a* defined by an arrangement of edges including an interior frontal edge 11*b* (see FIG. 3*a*) and an upper frontal edge 11*d* (see FIGS. 3, 3*a*), where the upper frontal edge 11*d* of the frontal opening 11*a* can also be considered a lower frontal edge of the shell 11. The outer shell 11 also includes a brow region 11*c* (see FIG. 1*a*) that resides above the upper frontal edge 11*d* and that overlies a brow of the wearer 500 of the helmet 10, when the helmet 10 is worn (see FIG. 3). The outer shell 11 also includes a thickened segment 11*g* that extends laterally along the upper frontal edge 11*d* and into an interface area 11*e* (see FIGS. 3, 5*b*, 12 and 13). As shown in FIGS. 5*b* and 13, an angled transition wall 11*h* leads to the thickened segment 11*g*. Preferably, the geometry of an inner surface 17 of the shell 11 is not altered to form the thickened segment 11*g*. Focusing on FIGS. 1*b* and 12, the thickened segment 11*g* and the interface area 11*e* are raised relative to the adjacent portion of the shell 11. The outer shell 11 is preferably made of a suitable plastic material having the requisite strength and durability characteristics to function as a football helmet, or other type of protective helmet, such as polycarbonate plastic materials, one of which is known as LEXAN®, as is known in the art.

Figure 1A:
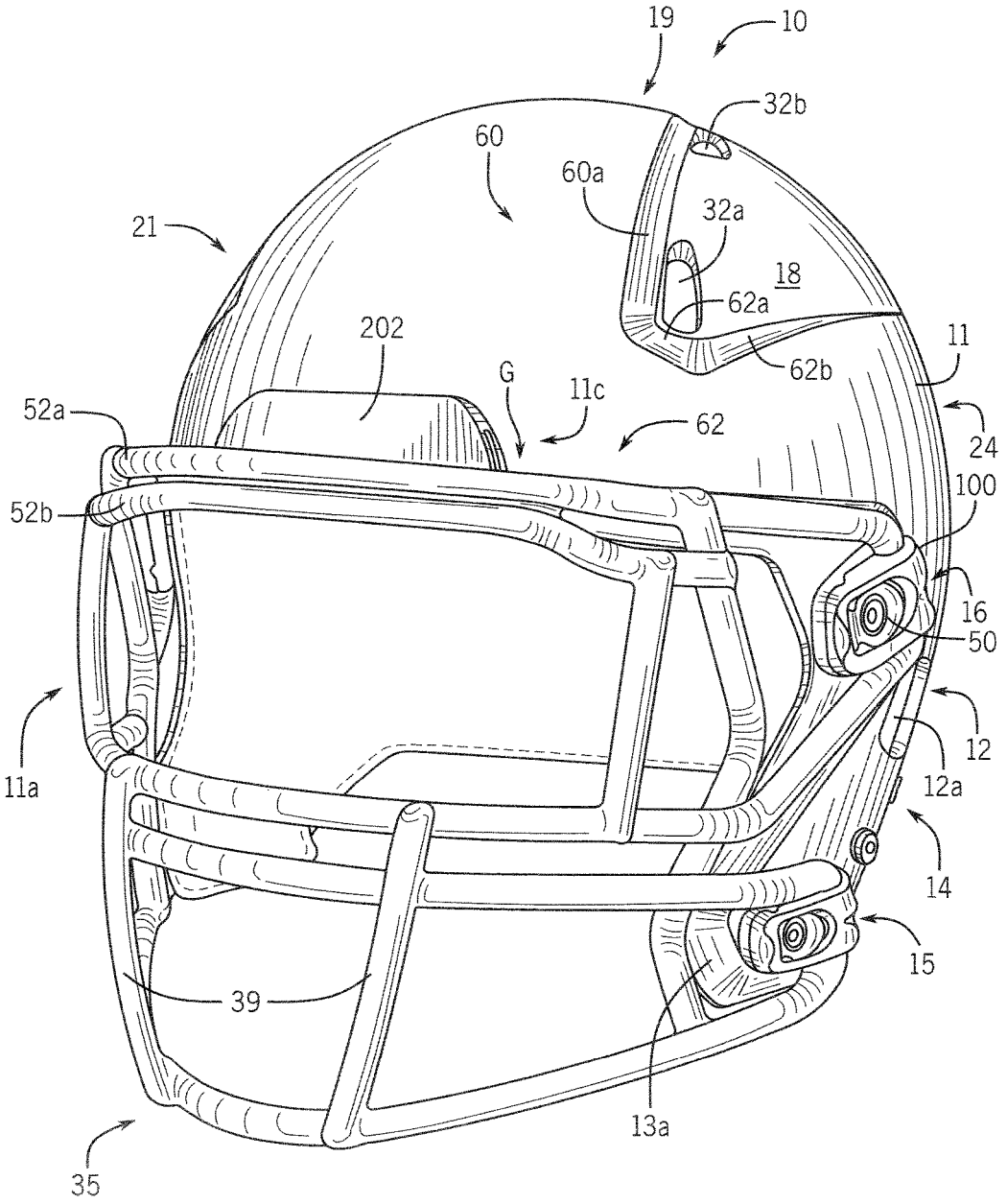
FIG. 1*a* is a perspective view of the helmet of FIG. 1, where the internal padding of the sport helmet has been removed.
Figure 2:
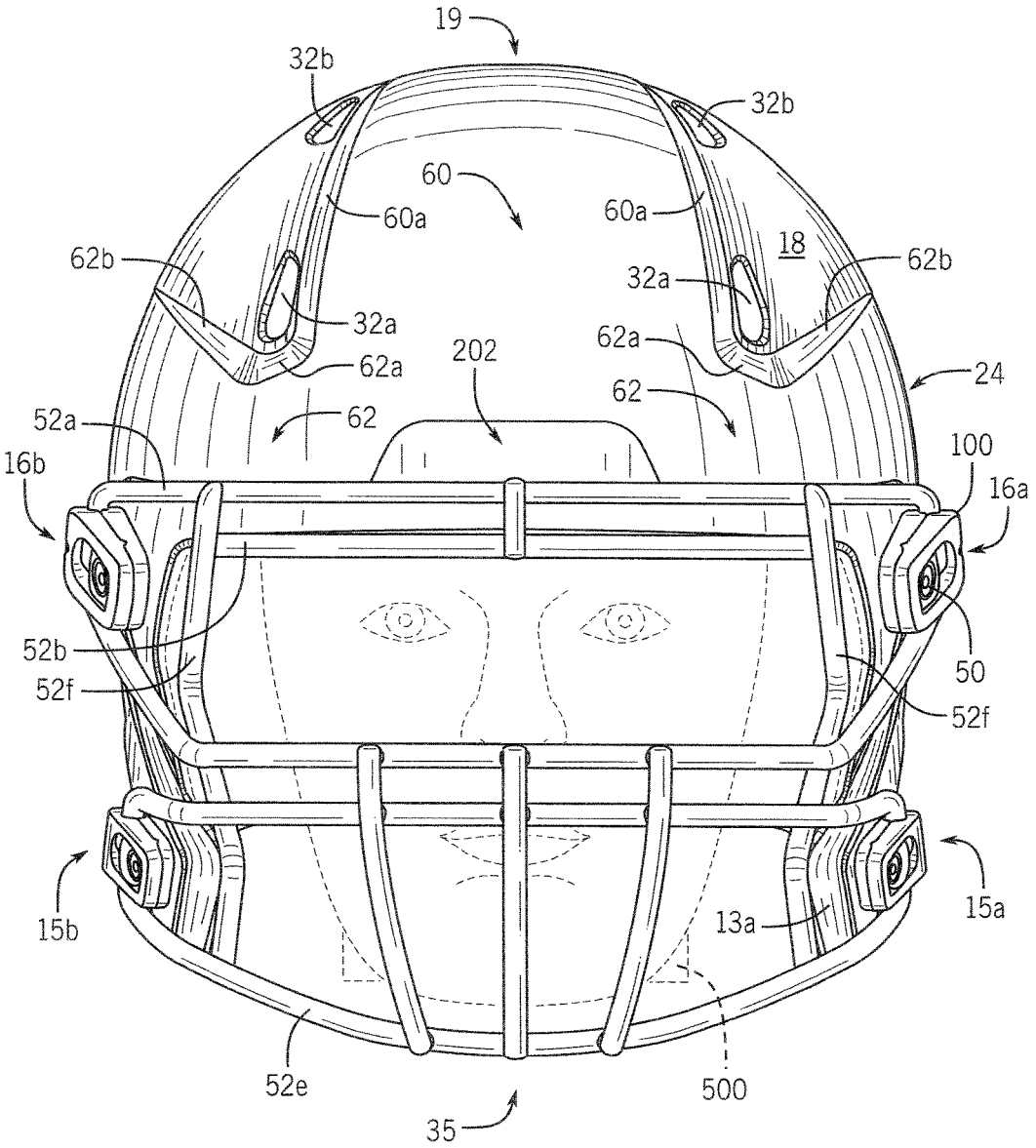
FIG. 2 is a front view of the helmet of FIG. 1, including an alternative faceguard design.
Figure 2A:
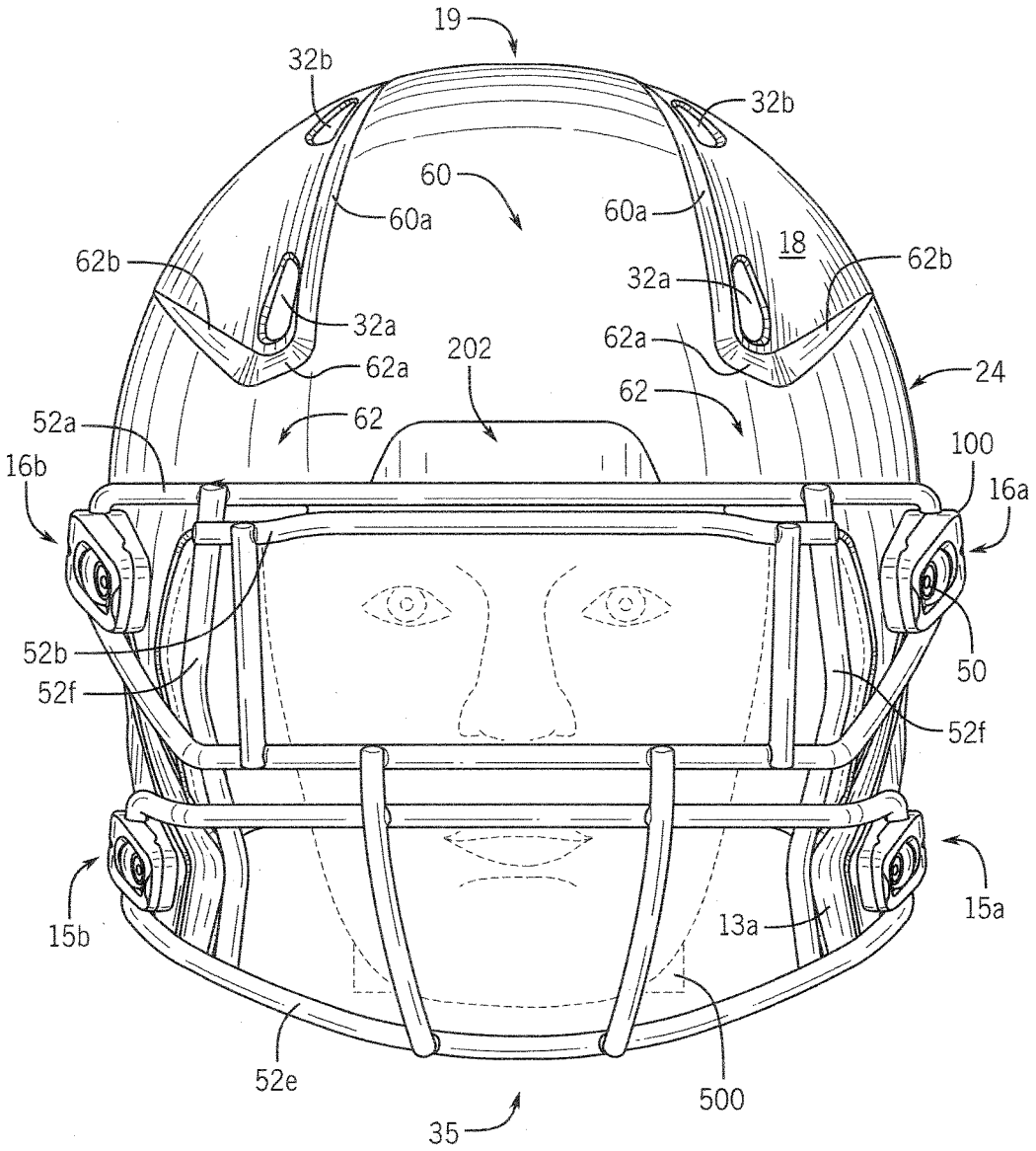
FIG. 2*a* is a front view of the helmet of FIG. 1.
Figure 3:
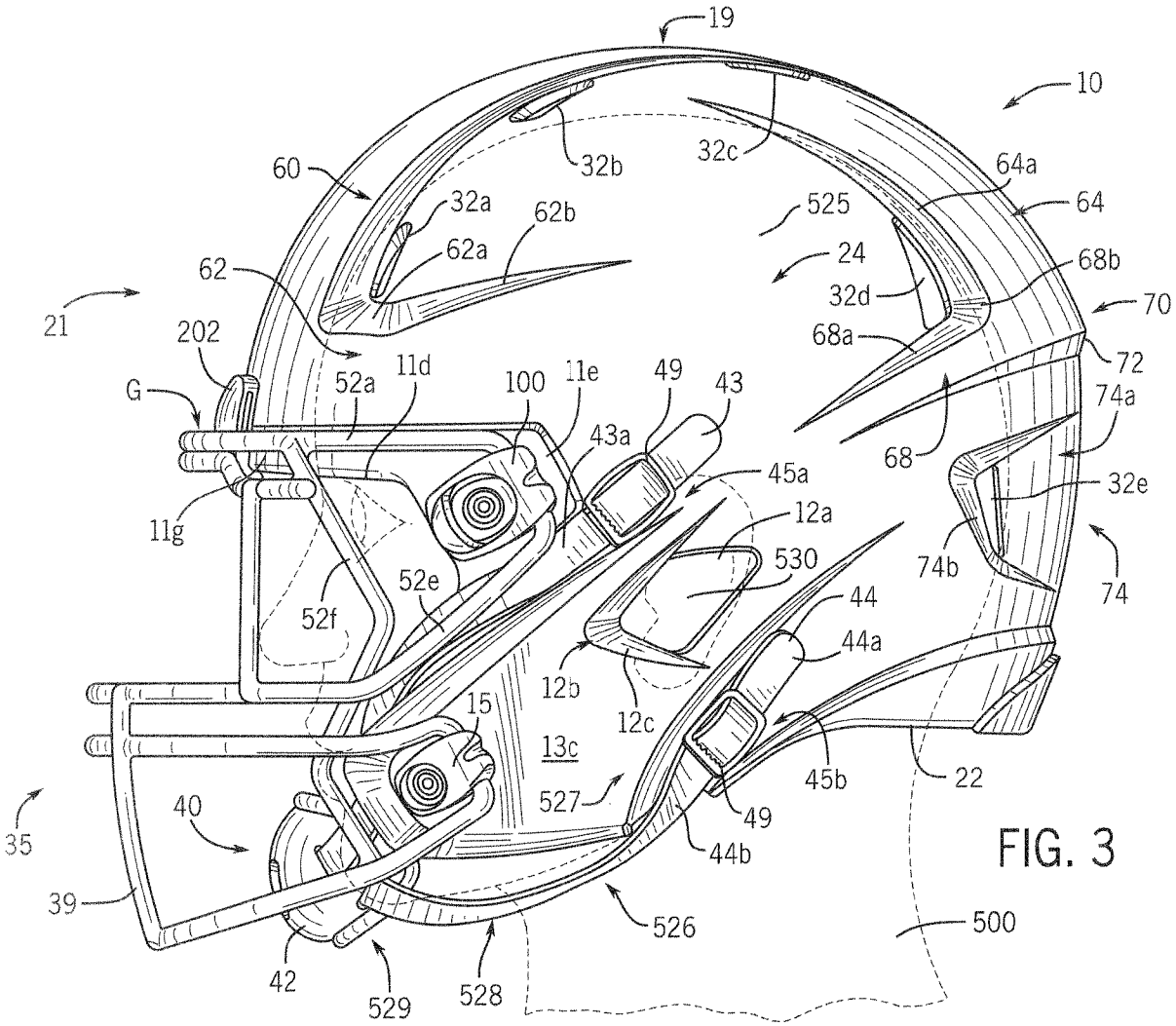
FIG. 3 is a side view of the helmet of FIG. 1, including a wearer of the helmet being partially shown in phantom lines.

Alternatively, the shell is made from a fiber reinforced plastic resin, wherein carbon fibers are utilized. Outer shell 11 has an inner wall surface 17 (FIG. 12) and an outer wall surface 18. Referring to FIGS. 1-3, the shell 11 further includes a crown 19, a back or rear 20, a front 21, a lower edge surface 22, and two side regions 24 (which include the ear flap 12 and jaw flap 13). As is known in the art, and as will be hereinafter described in greater detail, shell 11 is adapted to receive the head 525 of a wearer 500 of the helmet 10. Referring to FIG. 3, the wearer or player 500 has a jaw or mandible 526 (FIG. 3) that generally comprises a substantially vertical ramus portion 527, a body or side portion 528, and a frontal or mental protruberance or chin portion 529. As shown in FIG. 3, the body portion 528 extends between the ramus portion 527 and the chin 529. The ramus portion 527 includes an upper segment with coronoid and condyloid processes that are proximate and forward of ears 530 of wearer 500.

With reference to FIGS. 1, 1*a*, 3, 11 and 17, each side region 24 of the shell 11 includes an ear flap 12, which is adapted to generally overlie an ear 530 (FIG. 3) and portion of a cheek of the wearer 500. Each ear flap 12 generally extends downwardly from the side region 24 to the lower edge surface 22 of shell 11. Each ear flap 12 includes a jaw flap 13 that extends from its corresponding ear flap 12 forwardly toward the front 21 of the shell 11. As seen in FIG. 3, the jaw flap 13 is adapted to generally extend to overlie a portion of the body portion 528 of the jaw 526 of the wearer 500 of the helmet 10. As shown in FIG. 3, jaw flap 13 extends forwardly to overlie a forwardly disposed portion of the jaw 526 disposed toward the chin 529 of wearer 500. The jaw flap 13 extends forwardly enough to overlie a portion of the side of the chin 529 of wearer 500, but not the entire chin 529. The jaw flap 13 does not need to extend to completely cover the chin 529 of the wearer 500, but it is contemplated that it may extend to completely cover the chin 529 in some embodiments, or based on the specific anatomy of some wearers. It is further contemplated that the jaw flap 13 will not cover any portion of the chin 529 of the wearer 500 in other embodiments, or based on the specific anatomy of some wearers. In this regard, it should be noted that helmets 10 of the present invention are generally made with outer shells 11 of varying sizes, dependent upon the size of the head of the particular wearer of the helmet. It is also noted that players are fitted for helmets by trained personnel in accordance with written fitting guidelines. In FIG. 3, a properly-sized helmet 10 is shown superimposed upon what is believed to be an average size head of a wearer of the helmet 10, whereby jaw flap 13 is shown to generally overlie the entire ramus 527 of the jaw 526 and at least some of the body portion 528 of the jaw 526, including a forwardly disposed portion of jaw 526 adjacent the chin 529 of wearer 500, including overlying at least some portion of the side of the chin 529 of wearer 500. Since FIG. 3 is not a representation of all sizes of heads and all types of chin structures, such as chins which may greatly extend outwardly away from the head of the wearer, it should be understood that it is perhaps possible that someone wearing a helmet 10 in accordance with the present invention may have a larger or smaller side portion of his or her chin extending outwardly further beyond the outer periphery of jaw flap 13. When the helmet 10 is properly sized and fitted to the wearer 500, it is believed that jaw flap 13 will overlie some portion of the body 528 of the jaw 526 of virtually all wearers of helmets 10.

Figure 11:
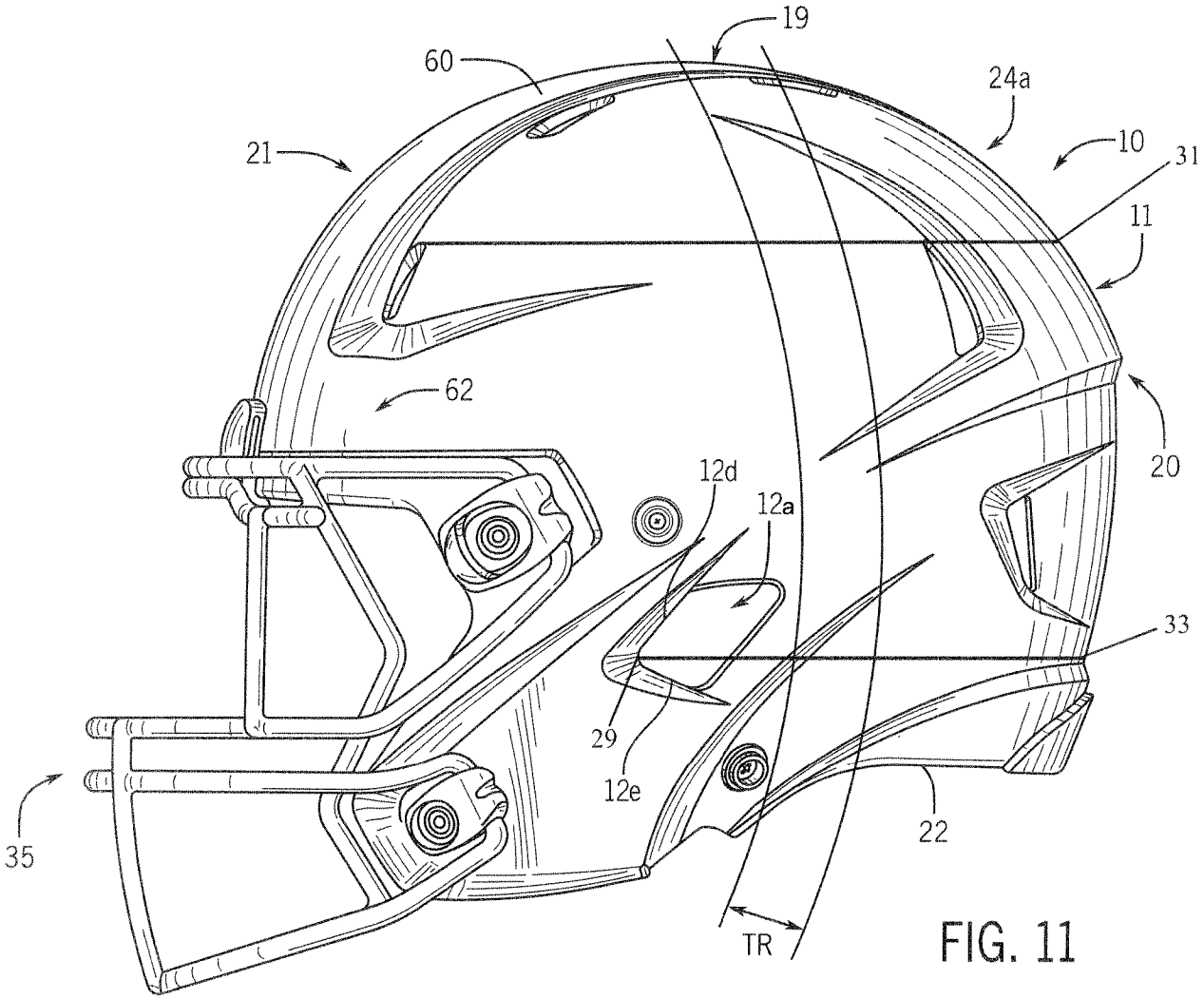
FIG. 11 is a side view of the helmet of FIG. 1 showing a transitional region of the shell.

As shown in the Figures, the helmet shell 11 has an arrangement of complex contours. Referring to FIGS. 1, 1*a*, 1*b*, 2, 2*a*, 3, 11 and 12, the shell 11 has a raised central band 60 extending rearward from the front shell portion 21 and along the crown 19. The raised central band 60 has an initial frontal width that is reduced as the band 60 extends rearward through the crown 19. In one embodiment, the initial frontal width is approximately 5 to 6 inches. Also, the band 60 has an initial frontal height defined by a beveled (or inclined) sidewall 60*a* that is reduced along the band 60, whereby a rear segment of the band 60 is substantially flush with the outer surface 18 of the shell 11, preferably being flush rearward of a midpoint of the crown 19. As shown in FIGS. 1, 1*a*, 1*b*, 2, 2*a*, 3, a pair of opposed front ridges 62 extend transversely and substantially upward from the band 60 and towards the ear flap 12. As shown in FIG. 1, the ridge 62 has an initial frontal height defined by a first beveled sidewall segment 62*a* that extends laterally and downwardly from the sidewalls 60*a* of the band 60. Also, as shown in FIGS. 1, 1*a*, 1*b*, 2, 2*a*, 3, the lateral ridges 62 have a second beveled sidewall segment 62*b* that extends laterally and upwardly towards the ear flap 12. Due to its upward extension, a midpoint of the second sidewall segment 62*b* is approximately 1.5 to 2 inches above the uppermost faceguard bar 52*a* and the frontal opening upper edge 11*d*. Preferably, the second sidewall segment 62*b* is reduced along the ridge 62, whereby a peripheral segment of the ridge 62 is substantially flush with the outer shell surface 18. Most preferably, the ridge 62 is flush with the outer shell surface 18 at a point that is rearward of the dynamic connector 16, substantially aligned with the upper chin strap connector 45*a*, and/or substantially aligned with the angled frontal ridge 12*b* of the ear opening 12*a*. As shown in FIGS. 1*b*, 3, 6, and 11, a first set of ventilation openings, or air vents, 32*a-c*, are arranged along the sidewall 60*a* of the band 60. Although only the left half of the helmet 10 is shown in FIGS. 3 and 11, the helmet 10 is symmetric and it is understood that the structures and features shown on the left half, including openings 32*a-c* along the right side wall of the band 60, are also present on the right half (not shown) of the helmet 10. Preferably, the openings 32*a*, 32*b*, 32*c* in the first set on the left half of the helmet 10 are collinear with each other, and the openings in the second set (on the right half of the helmet 10) are also collinear with each other. Because the band 60 has a rearward taper, the distance between opposed openings 32*a*, 32*b*, 32*c* in the first and second sets, as measured across the band 60, decreases. The initial frontal opening 32*a* is adjacent to an inner shoulder of the ridge 62 and the band 60. Specifically, as shown in FIGS. 1, 1*a*, 1*b*, 2, 2*a*, 3, 6, 6*a*, 7, 8, and 11-13, the frontal vent opening 32*a* is positioned substantially adjacent to the raised central band 60 and the raised lateral ridge 62. Preferably, as shown in these figures, the frontal vent opening 32*a* is located adjacent to a base portion of the sidewall 60*a* and the first sidewall segment 62*a*, as these sidewalls 60*a*, 62*a* extend outward from the outer surface 18 of the shell 11.

Figure 6:
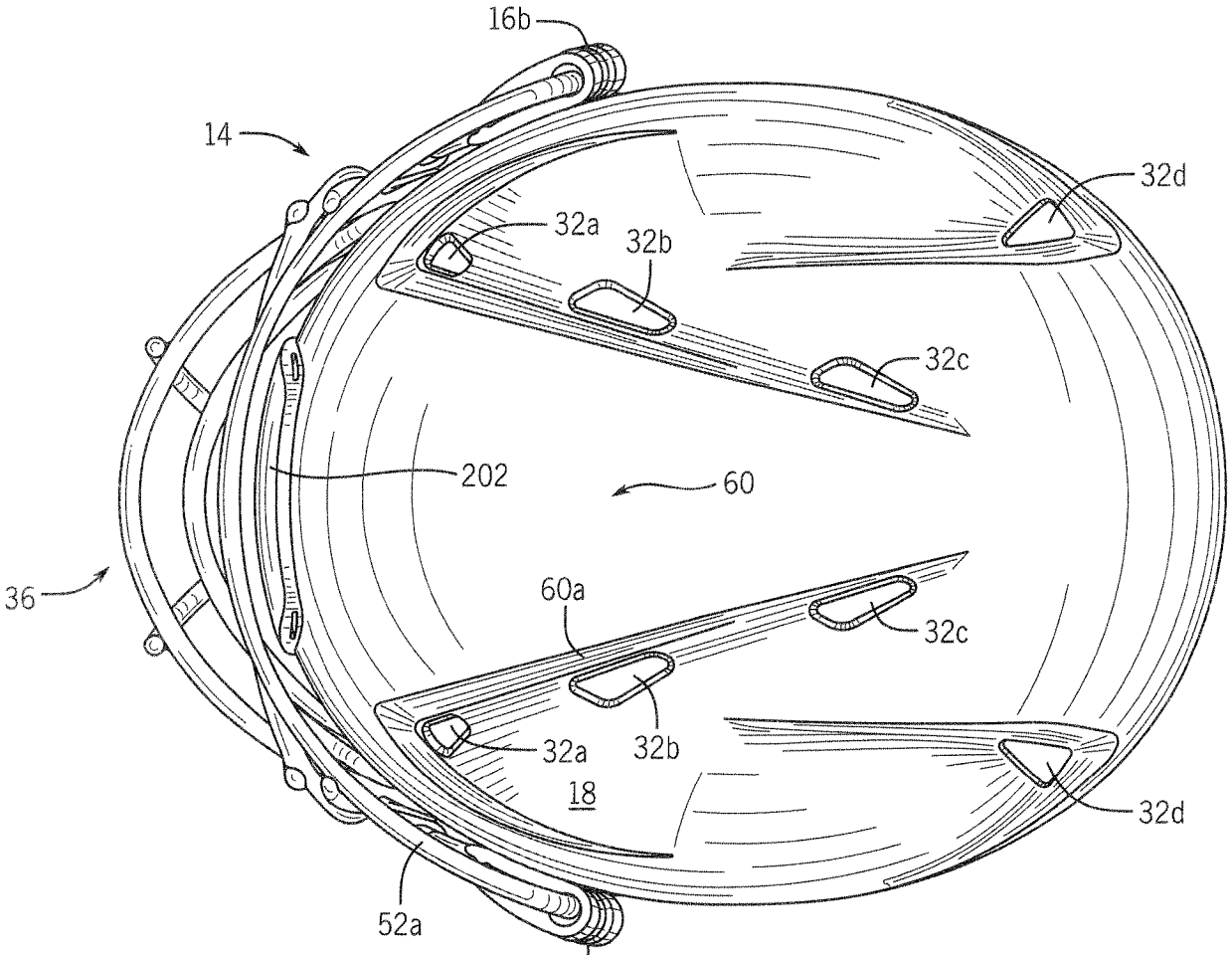
FIG. 6 is a top view of the helmet of FIG. 1, showing the energy attenuating system of the helmet in an installed position, $P_I$.
Figure 6A:
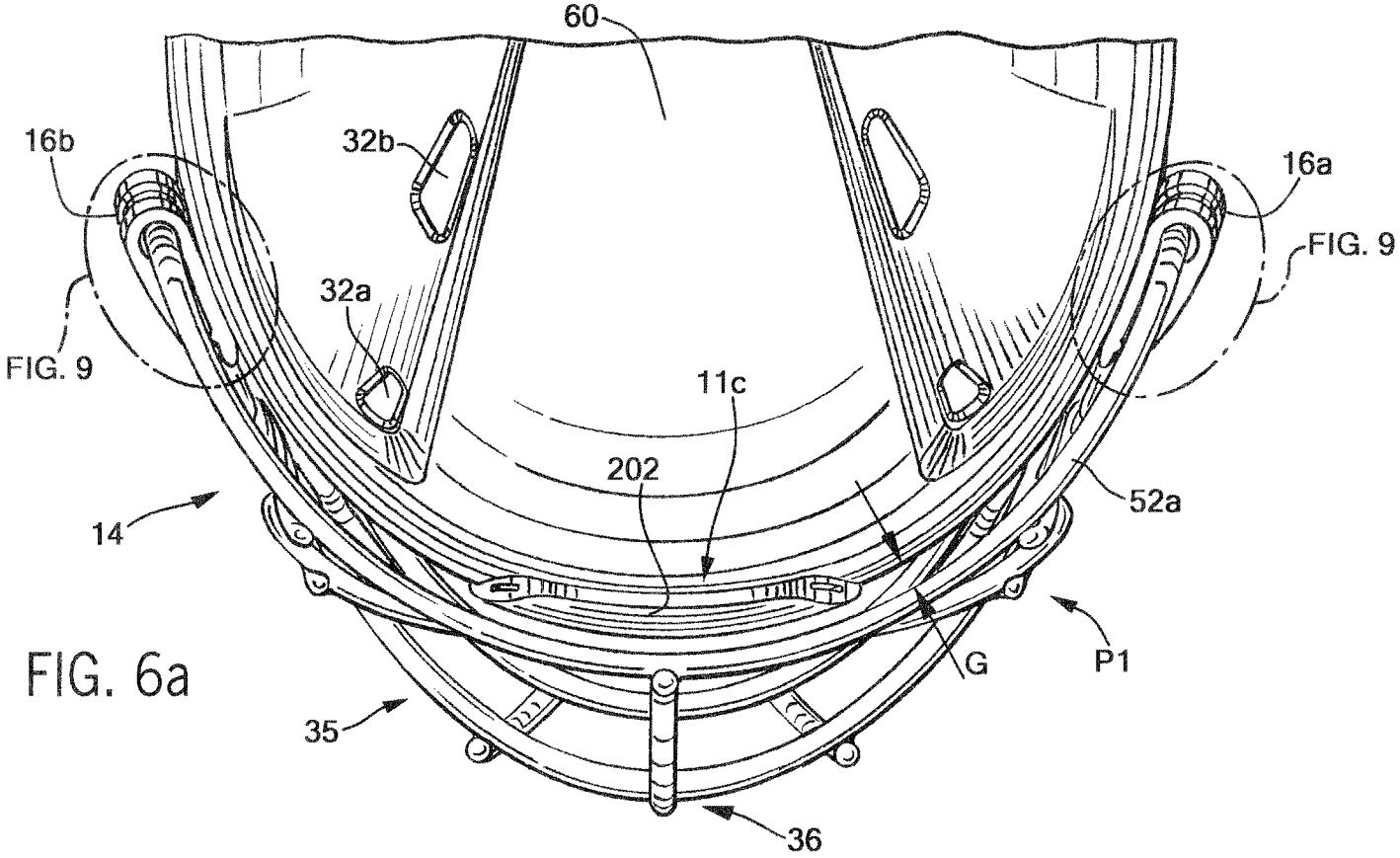
FIG. 6*a* is a partial top view of the helmet of FIG. 1, showing the energy attenuating system of the helmet in the installed position, $P_I$.
Figure 12:
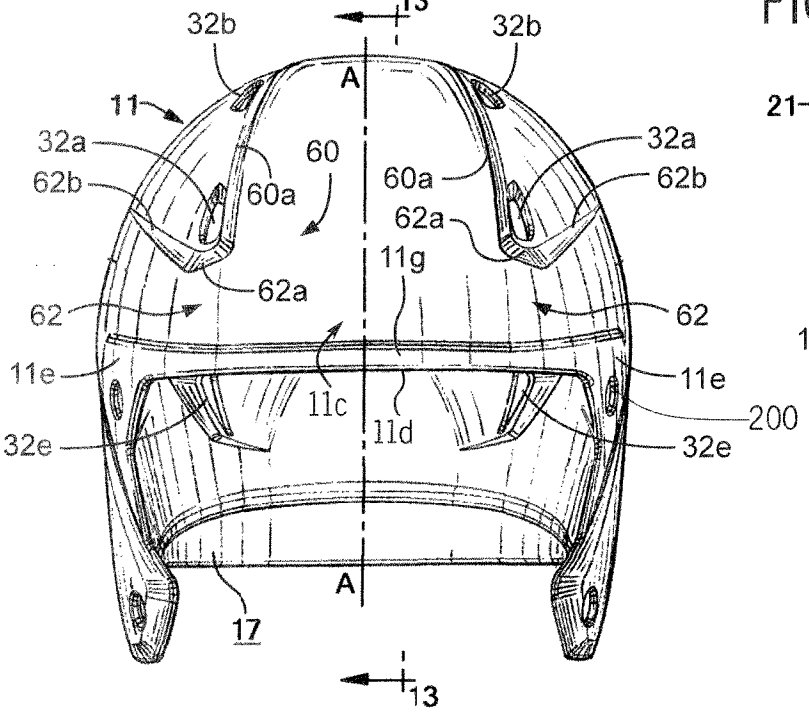
FIG. 12 is a front view of the helmet shell of FIG. 1.
Figure 17:
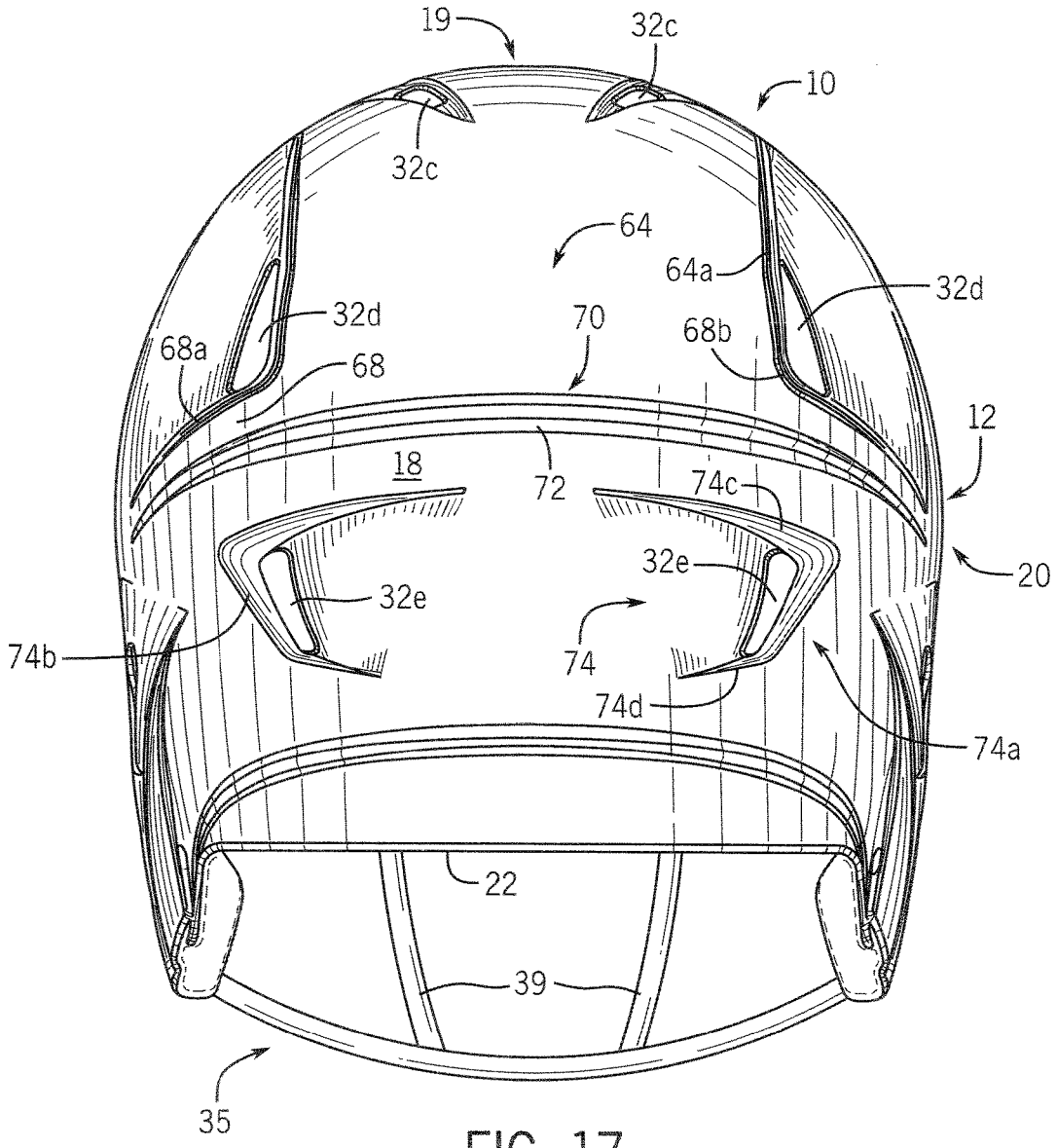

Referring to FIGS. 3, 6 and 17, the shell 11 further includes a raised rear band 64 that extends from the crown 19 rearward to the rear shell portion 20. The raised rear band 64 has a width that remains substantially constant as the band 64 extends rearward and downward. The rear band 64 also has opposed beveled (or inclined) sidewalls 64*a* that increases as the band 64 extends rearward. An initial segment of the band 64 commences forward of the rearmost opening 32*c* and is substantially flush with the shell 11. A pair of opposed rear beveled ridges 68 extend outward and downward from a rear segment of the band 64. The rear beveled ridges 68 have sidewalls 68*a* that decrease along their length whereby the ridges 68 gradually blend into the shell 11. A ventilation opening 32*d* resides adjacent an inner shoulder 68*b* between the ridges 68 and the band 64. Preferably, the ventilation opening 32*d* has a triangular configuration. The rear band 64 terminates proximate a substantially horizontal ledge 70 that extends between the side regions 24 of the helmet 10. The substantially horizontal ledge 70 includes an angled surface 72 extending between the rear band 64 and the outer shell surface 18. Below the ledge 70, the rear shell portion 20 includes a pair of recessed regions 74 in an opposed positional relationship. The recessed region 74 is defined by an arrangement of angled walls 74*a* that form a generally U-shaped configuration. A rear opening 32*e* resides within the recessed region 74 and is positioned adjacent to a frontal or leading wall 74*b* of the angled walls 74*a* and between an upper transverse wall 74*c* and a lower transverse wall 74*d*. The rear opening 32*e* has an elongated configuration with a major axis that is substantially vertical when the helmet 10 is positioned on the wearer's head. Further, the rear opening 32*e* has an upper width that exceeds a lower width. As shown in FIGS. 3 and 11, the rear openings 32*e* are positioned in the rear 20 of the shell 11 and below a first chord 31 that extends: (i) between the uppermost points of the frontal openings 32*a* and (ii) around the rear 20 of the shell 11. Additionally, FIGS. 3 and 11 show that the beveled sidewall 12*c* of the ear opening 12*a* has two internal edges 12*d*, 12*e* that meet to form a forward-most point 29 of the ear opening 12*a*. The rear openings 32*e* are positioned above a second chord 33 that extends: (i) between the forward-most points 29 of the ear openings 12*a* and (ii) around the rear 20 of the shell 11. As shown in FIG. 12, the shell 11 is configured such that the distance between the sidewall 60*a* of the raised central band 60 is less than the distance between the outer edges of the rear openings 32*e*.

Figure 3A:
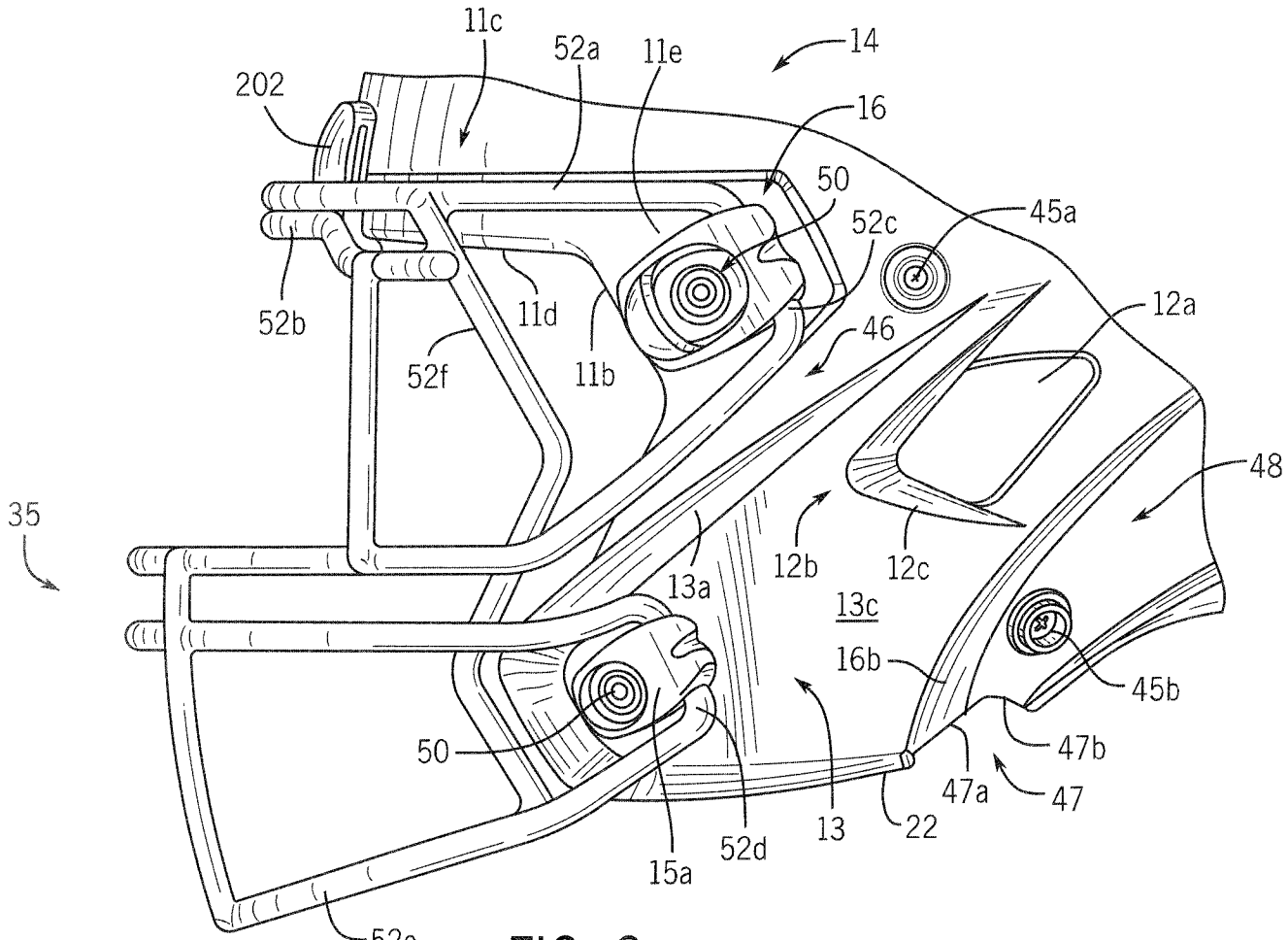
FIG. 3*a* is a side view of a portion of the helmet of FIG. 1 showing the energy attenuating system of the helmet.

With reference to FIGS. 3 and 3*a*, the helmet 10 includes a chin protector 40 that engages the chin 529 of wearer 500 and couples with the shell 11 in order to secure the helmet 10 on the wearer's head. The chin protector 40 includes a central protective member 42 that engages the wearer's chin 529 and at least two flexible members or straps 43, 44 extending from the central member 42. In use, the upper flexible member 43 engages with an upper connector 45*a* extending outward from the shell 11 above an ear opening 12*a* in the ear flap 12 and preferably rearward of the faceguard connector 16. Similarly, the lower flexible member 44 engages with a lower connector 45*b* extending outward from the shell 11 below the ear opening 12*a*. A frontal portion of the ear opening 12*a* is defined by an angled frontal ridge 12*b* with a beveled sidewall 12*c* (see FIG. 3*a*). An upper recessed channel 46 extends rearward from an interior frontal edge 11*b* of the shell frontal opening 11*a* and along the upper periphery of the jaw flap 13. The upper recessed channel 46 is adjacent an upper beveled surface 13*a* of the jaw flap 13 (see FIG. 3*a*), and the upper connector 45*a* is aligned with the upper recessed channel 46. A peripheral downwardly extending transverse bar 52*g* is cooperatively dimensioned with the upper channel 46 such that an upper flexible member 43 of the chin protector 40 is positioned between the transverse bar 52*g* and the upper channel 46. A lower recessed channel 48 extends from the lower edge 22 of the shell 11 upward and rearward along the lower periphery of the jaw flap 13. The lower recessed channel 48 is adjacent a lower beveled surface 13*b* of the jaw flap 13, and the lower connector 45*b* is aligned with the lower recessed channel 48. Due to the recessed nature of the upper and lower channels 46, 48, the jaw flap 13 defines an outermost jaw flap surface 13*c* of the shell 11 in the side region of the helmet 10. The shell 11 also includes a notch 47 formed in the lower edge shell surface 22 and below the ear opening 12*a*, and preferably, the notch 47 is aligned with the lower channel 48. Preferably, notch 47 has at least one angled segment 47*a* and potentially a plurality of angled segments 47*a, b* that result in a generally V-shaped configuration; however, other shapes of notches, if desired, could be utilized.

Each flexible member 43, 44 includes a coupler 49 with a female snap connector that engages with the male upper and lower connectors 45*a, b*, respectively, to define a secured position. When the chin protector 40 is in a secured position and the helmet 10 is on the wearer's head 500 (see FIG. 3), the upper channel 46 receives an extent 43*a* of the upper flexible member 43 and the lower channel 48 receives an extent 44*a* of the lower flexible member 44. Thus, in the secured position, the upper and lower flexible members 43, 44 are retained within the upper and lower channels 46, 48, respectively. In addition, a second extent 44*b* of the lower flexible member 44 passes through notch 47 which improves stability of the lower flexible member 44 while minimizing undesired movement of the member 44. In general, if a helmet is subjected to a downward impact force upon the face mask, the helmet tends to roll forwardly about a virtual pivot point located slightly above the ear openings. Notch 47 assists in resisting the undesired rolling effect by redirecting the lower flexible member's 44 line of action to a location farther away from the virtual pivot point. In addition, the securement configuration resulting from the channels 46, 48 and the notch 47 provide an improvement over the conventional 4 point hookup, or a "high hookup," of the chin protector because of improved stability of the helmet 10 on the wearer's head during play. Thus, the retention and proper positioning of the helmet 10 upon impact(s) is improved.

Referring to FIGS. 1, 1*a*, 1*b*, 2, 2*a*, 3, 3*a*, 4*a-c*, and 6-11, the helmet 10 features an energy attenuating faceguard mounting system 14, including the faceguard 35 and means for dynamically connecting the faceguard 35, which interact to reduce impact forces received on the faceguard 35 and transmitted to the helmet shell 11. Unlike conventional sports helmets and faceguard connectors 15, the energy attenuating faceguard mounting system 14 does not include a connection point with a front bumper 202 at the brow region 11*c* of the shell 11 for the faceguard 35. In one embodiment, the dynamic faceguard connecting means comprises a helmet shell connection segment that is movable relative to the remaining shell 11 and that receives a coupler for securement of the faceguard 35. The helmet shell connection segment can be integrally formed within the shell 11, for example in the ear flap 12. Alternatively, the helmet shell connection segment can be formed separately and then operatively joined to the shell 11. For example, the shell 11 can include a generally circular opening that receives and operatively connects with the helmet shell connection segment. The helmet shell connection segment can function similar to a butterfly valve where the connection segment includes a disc that is secured to the shell 11 by a rod and a peripheral region 38 of the faceguard 35 is secured to the rod either directly or via an actuator. When an impact force is applied to the faceguard 35, a portion of the connection segment, for example the disc, moves or rotates relative to the remaining shell 11 which allows for movement of the peripheral faceguard region 38. Alternatively, the helmet shell connection segment can flex inward and/or outward when the impact force is applied to the faceguard 35. In another embodiment, the dynamic faceguard connecting means comprises a plunger assembly coupled to the helmet shell 11 wherein a first plunger component moves relative to the shell 11 (e.g., substantially normal to the shell 11) when an impact force is applied to the faceguard 35. The movement of the plunger assembly facilitates movement of the faceguard 35, including a peripheral faceguard region 38, when the impact force is received by the faceguard 35. In another embodiment, the dynamic faceguard connecting means comprises the dynamic faceguard connector 16. Referring to FIGS. 1-3*a* and as explained below, the helmet 10 includes two dynamic connectors 16, one on each side region 24 of shell 11 positioned slightly above the ear opening 12*a*. The helmet 10 also includes a pair of lower (non-dynamic) connector 15 positioned on the jaw flap 13 near the lower shell edge 22. Alternatively, the helmet 10 may include a greater number of dynamic connectors 16, for example, four dynamic connectors 16 wherein the helmet 10 has a pair of upper dynamic connectors 16 and a pair of lower dynamic connectors 16.

The faceguard 35 comprises a plurality of elongated bar members 39, which may be formed of any suitable material having the requisite strength and durability characteristics to function as a football helmet faceguard. The members 39 may be preferably formed of a metallic material, such as steel or titanium, and as is known in the art, the bar members 39 may be provided with a durable coating (e.g., plastic coating). Additionally, the bar members 39 may be of a solid or tubular cross-sectional configuration. Alternatively, bar members 39 may be formed of a suitable plastic material, including a fiber reinforced plastic resin, having the requisite strength and durability characteristics to perform the functions of a football helmet faceguard. The faceguard connectors 15, 16 encircle portions of the bar members 39 of the faceguard 35. The faceguard connectors 15, 16 are shown with a quick release coupler 50, which is described in more detail in pending U.S. patent application Ser. No. 12/082,920, which is incorporated herein by reference. Alternatively, an elongated fastener, such as a threaded screw, may be employed with the faceguard connectors 15, 16 to secure the faceguard 35 to the helmet 10.

Figure 1B:
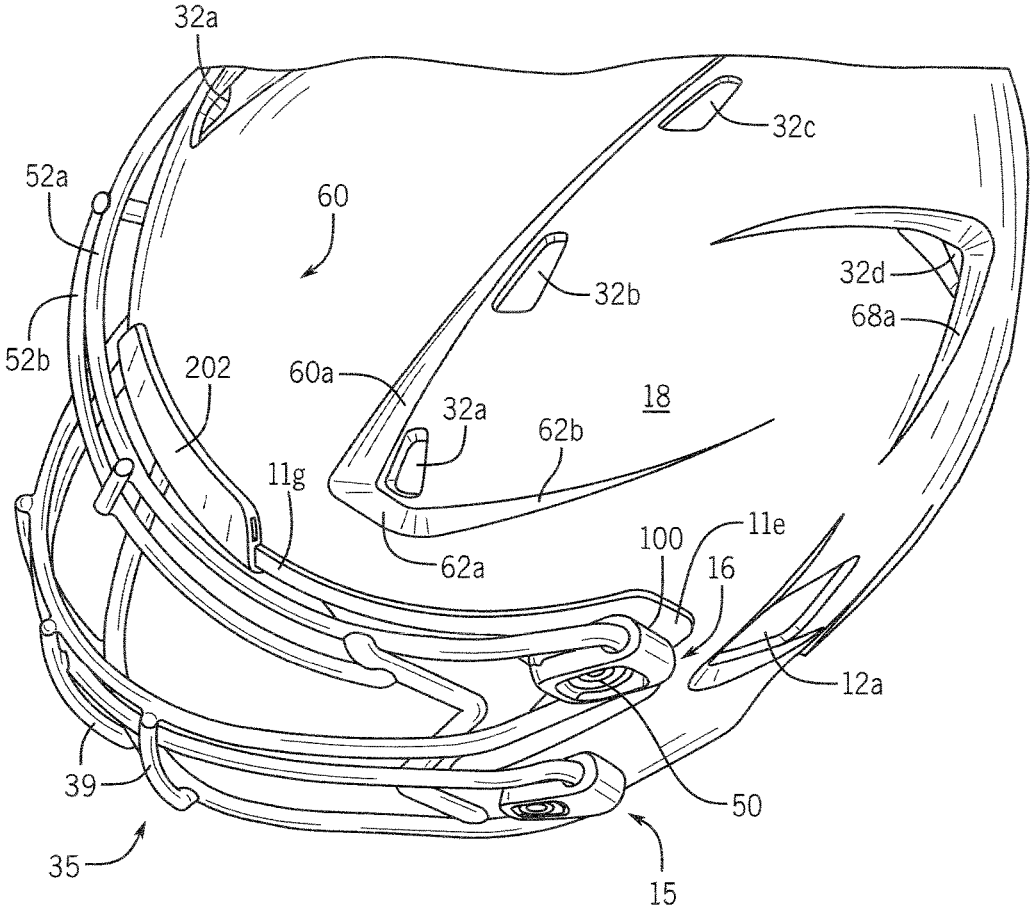
FIG. 1*b* is an elevated perspective view of the helmet of FIG. 1.

Referring to at least FIGS. 1, 1*b*, 3 and 3*a*, a pair of dynamic faceguard connectors 16 and the quick release coupler 50 connect an upper portion of the faceguard 35 to an interface area 11*e* of the shell 11 at the ear flap 12 and over a superior (or frontal) portion of the helmet wearer's temporal lobe. As shown in FIGS. 1*b*, 12 and 13, the interface area 11*e* is raised relative to the adjacent portion of the shell 11. Also, as shown in these figures, opposed ends of the thickened segment 11*g* adjoin the interface areas 11*e* to provide a continuous, uninterrupted frontal offset of the shell 11. The interface area 11*e* has significant dimensions such that it extends from the interior frontal edge 11*b* rearward past a shell opening 200 (that receives an extent of the coupler 50). Focusing on FIG. 3*a*, a rear edge of the interface area 11*e* is positioned rearward of the faceguard 35, the upper faceguard connector 16, and the lower faceguard connector 15. Preferably, the faceguard connector 16 is positioned adjacent the interior edge 11*b* of the frontal shell opening 11*a* and below an upper edge 11*d* of the frontal opening 11*a*. More preferably, the faceguard connector 16 is positioned above the ear opening 12*a* and the jaw flap 13. The dynamic faceguard connectors 16 define an uppermost faceguard securement point located over the helmet wearer's superior temporal lobe and lateral to the brow region 11*c* of the shell 11. The uppermost faceguard securement point is also below the frontal opening upper edge 11*d* and upper substantially horizontal bar 52*a* of the faceguard 35, and above the ear opening 12*a* and jaw flap 13. At least one horizontal upper bar 52*a* of the faceguard 35 extends between the dynamic faceguard connectors 16 and the opposed faceguard securement points provided by the dynamic connectors 16. A second substantially horizontal upper bar 52*b* is proximate and below the upper bar 52*a* and extends between transverse intermediate bars 52*f*. Alternatively the transverse intermediate bars 52*f* are omitted and the second upper bar 52*b* is joined with the first upper bar 52*a*. Both of the upper bars 52*a, b* are offset from the shell 11 and do not contact the brow region 11*c* (or front region) of the shell 11. In other words, the upper bars 52*a, b* extend between the connectors 16 and along the brow region 11*c* without connecting to the brow region 11*c*. Thus, at least the uppermost bar 52*a* spans frontal opening 11*a* and the distance between the dynamic connectors 16 without connecting to the nameplate (or front bumper) 202 affixed to the brow region 11*c*. Accordingly, the brow (front) region 11*c* of the shell 11 lacks a faceguard connector. The upper bars 52*a, b* have a length with a curvilinear configuration that substantially corresponds to the curvilinear configuration of the brow region 11*c* of the shell 11. The offset between the upper bars 52*a, b*, and the shell 11 forms a gap G or standoff (see FIGS. 5, 6 and 6*a*) that is generally greater than 0.25 inch, and preferably between 0.25 inch and 0.5 inch. Unlike the present invention, conventional helmets include a faceguard that is secured to the helmet by at least one connector, typically a pair of connectors, coupled to the helmet's brow region whereby at least one upper bar, typically two upper bars contact the brow region. Conventional faceguards are further secured by at least one additional pair of connectors, each being coupled to an earflap of the shell.

Figure 10:
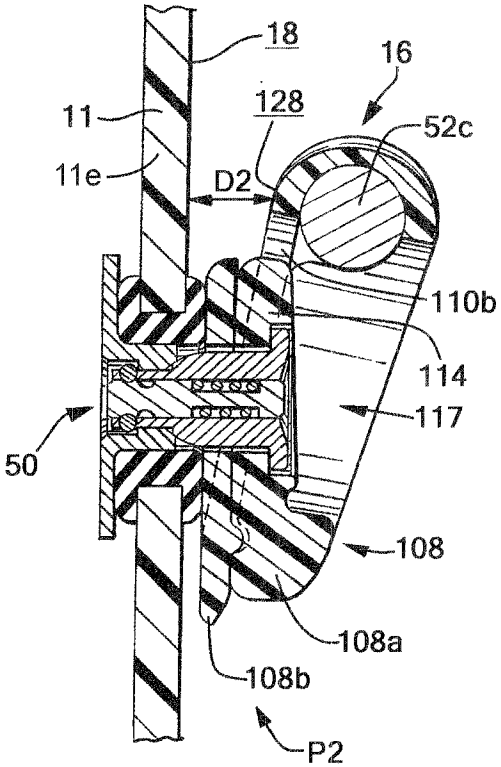
FIG. 10 is a cross-sectional view of the dynamic faceguard connector assembly affixed to the helmet of FIGS. 7 and 8 and shown within dotted lines therein.
Figure 9A:
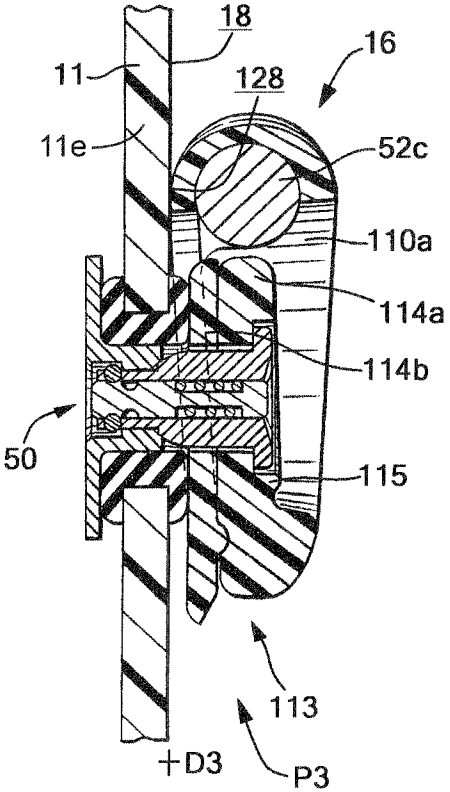
FIG. 9*a* is a cross-sectional view of the dynamic faceguard connector assembly affixed to the helmet of FIG. 8 and shown within dotted lines therein.
Figure 9:
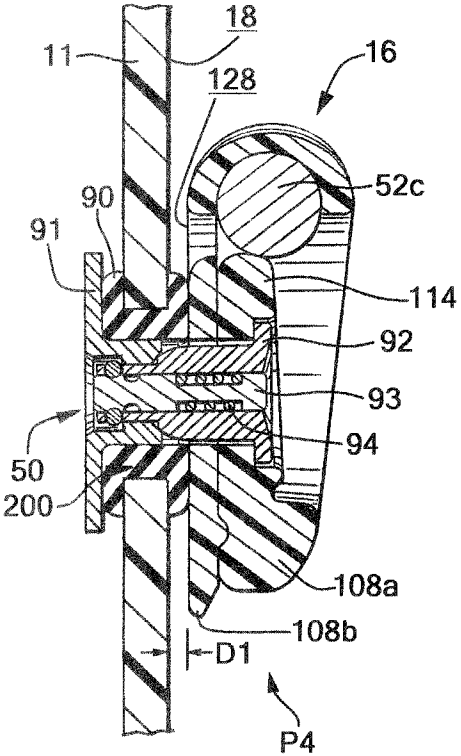
FIG. 9 is a cross-sectional view of the dynamic faceguard connector assembly affixed to the helmet of FIG. 6*a* and shown within dotted lines therein.

Referring to FIGS. 9, 9*a* and 10, the dynamic connector 16 includes the quick release coupler 50 that extends through a grommet 90 positioned within a shell opening 200. The coupler 50 is received by a fastening washer 91 that extends through both the grommet 90 and the shell opening 200. As explained in pending U.S. patent application Ser. No. 12/082,920, which is incorporated by reference, the quick release coupler 50 also comprises sleeve body 92, an actuator or pin 93, and a spring 94. The sleeve body 92 receives the actuator 93 to removably secure the dynamic connector 16 to the shell 11. As briefly explained above, the quick release coupler mechanism 50 is employed to secure the dynamic faceguard connectors 16 to the shell 11. The coupler mechanism 50 that provides for rapid attachment and detachment of the connectors 16 and the faceguard 35 from the shell 11 without the deliberate and time-consuming use of a screwdriver (or cutting tool for removal). The releasable coupler mechanism 50 extends through the opening 120 in the bracket 100 and into a shell opening 200. The coupler mechanism 50 further includes a head, a washer, ball, and a retaining notch. The coupler 50 is retained in a use position (see FIG. 9) by the engagement between the ball, the retaining notch and the distal end segment of the pin. To move the coupler 50 the use position through an intermediate position to a disconnected position, an inwardly directed actuation force is applied to the pin by an object. Once these internal coupler components are disconnected, the bracket 100 can be removed to allow for removal of the faceguard 35 to arrive at the disconnected position.

Figure 4B:
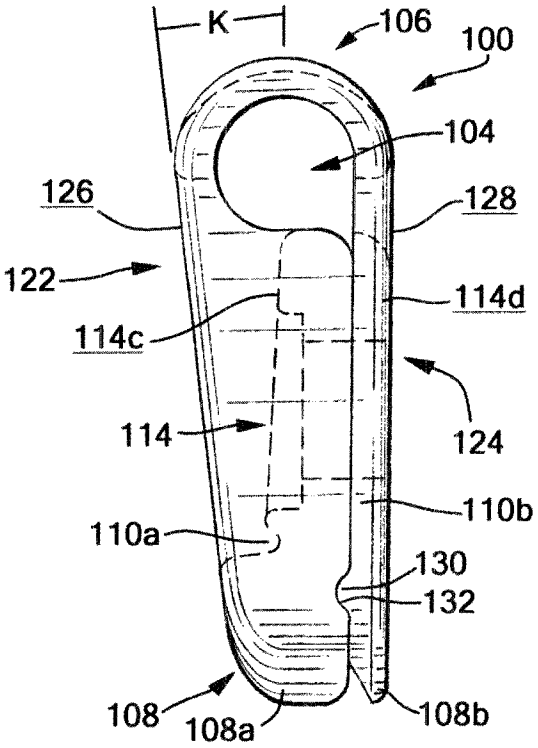
FIG. 4*b* is a side view of the dynamic faceguard connector of the energy attenuating system of the helmet of FIG. 1.
Figure 4A:
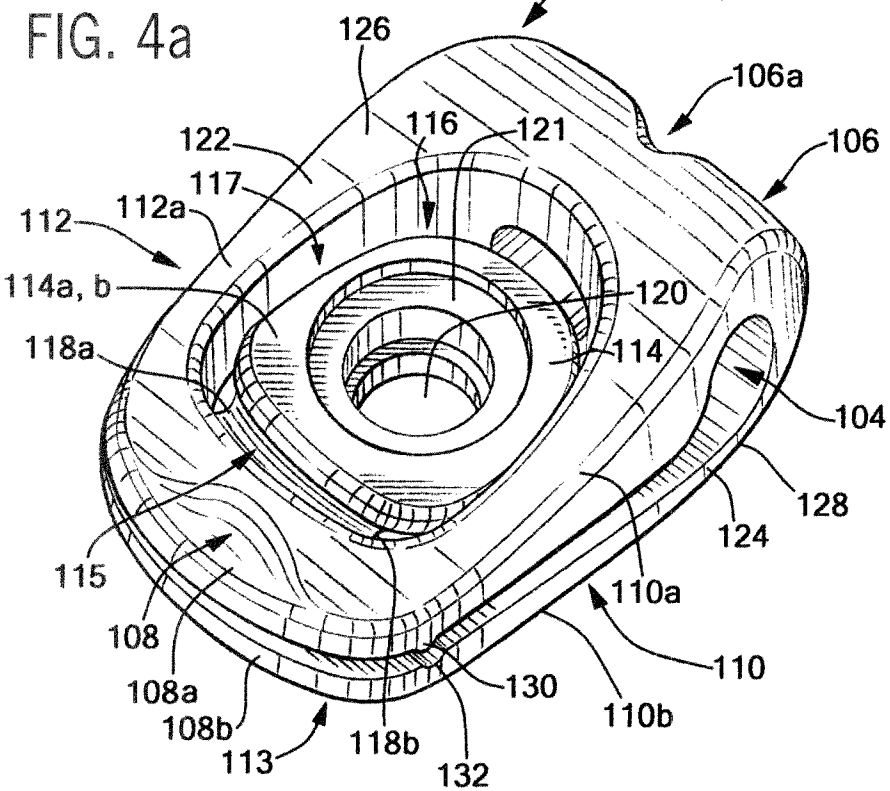
FIG. 4*a* is a perspective view of the dynamic faceguard connector of the energy attenuating system of the helmet of FIG. 1.

As shown in FIGS. 3*a*, 4*a*-4*c*, the dynamic faceguard connector 16 comprises a bracket 100 with a movable segment and a stable segment that are operatively connected to each other to facilitate movement of the faceguard 35 when an impact force is applied thereto. In the embodiment shown in the Figures, the bracket's movable segment is the peripheral bracket segment 113 and the stable segment is the internal segment 114. The bracket 100 also includes a band or strap member 102 that wraps around a peripheral bar member 52*c* that extends downwardly and transversely from the upper bar member 52*a*. The lower faceguard connector 15 (discussed in greater detail in pending U.S. patent application Ser. No. 12/082,920) also comprises a bracket 15*a* with a band that encircles the periphery of a peripheral member bar 52*d* that extends upwardly and transversely from a lower bar member 52*e*. The band 102 of bracket 100 forms a receiver 104 that encircles the bar 52*c*, wherein the receiver 104 provides a single encircling point for the faceguard bar 52*c*. The receiver 104 is oriented substantially perpendicular to the longitudinal axis of the bracket 100. The bracket 100 additionally includes a rear flange 106, that includes the band 102 and the receiver 104, and a frontal tab 108. As shown in FIG. 4*a*, the flange 106 also includes an indentation 106*a* located approximately at a mid-point of the width of the flange 106. A first side rail 110 and a second side rail 112 extend between the flange 106 and the frontal tab 108. The flange 106, the frontal tab 108, and the side rails 110, 112 collectively comprise the peripheral segment 113 of the bracket 100. The bracket 100 has a "clam-shell" design such that it opens about the receiver 104 and flange 106 to receive the faceguard bar 52*c*. Due to the clam-shell configuration, the bracket 100 has an outer half or portion 122 and an inner portion 124, as described in more detail below, that meet at a rear seam extending along the receiver 104. Thus, the peripheral segment 113 of the outer portion 122 includes an outer side rail segment 110*a* of the first side rail 110, an outer side rail segment 112*a* of the second side rail 112, and an outer segment 108*a* of the frontal tab 108. Similarly, the peripheral segment 113 of the inner portion 124 includes an inner side rail segment 110*b* of the first side rail 110, an inner side rail segment 112*b* of the second side rail 112, and an inner segment 108*b* of the frontal tab 108. Consequently, the first side rail 110 comprises the outer side rail segment 110*a* and the inner side rail segment 110*b*; the second side rail 112 comprises the outer side rail segment 112*a* and the inner side rail segment 112*b*; and the frontal tab 108 comprises the outer segment 108*a* and the inner segment 108*b*.

The connector bracket 100 includes a hinged internal segment 114 that enables the bracket 100 to flex when impact forces are applied to the faceguard 35. As explained below, the peripheral segment 113 flexes or moves relative to the internal segment 114 when an impact force F is applied to the face guard 35. Because the bracket 100 has a clam-shell configuration, the hinged segment 114 has an outer portion 114*a* associated with the outer portion 122, and an inner portion 114*b* associated with the inner portion 124. The hinged internal segment 114 connects to the frontal tab 108, and includes a frontal recess 115 at the interface with the frontal tab 108. The frontal recess 115 defines a hinge line 115*a* for the internal segment 114, wherein both are substantially perpendicular to the longitudinal axis of the bracket 100. A rear extent of the hinged internal segment 114 that is opposite the frontal recess 115 is free or not connected to the first side rail 110 and the second side rail 112. Also, the hinged internal segment 114 does not connect to the flange 106 and therefore, the hinged internal segment 114 and the flange 106 move independently of each other. A gap 116 is formed between the hinged internal segment 114, the first side rail 110, the second side rail 112, and the peripheral flange 106, namely the internal walls of same. The gap 116 includes opposed recesses 118*a*, 118*b* disposed adjacent the frontal tab 108. The opposed recesses 118*a*, 118*b* separate the hinged internal segment 114 from the first side rail 110 and the second side rail 112, allowing motion of the side rails 110, 112 relative to the hinged internal segment 114. The gap 116 has curvilinear segments as shown in FIG. 3*a*. The curvilinear segments of the gap 116 are complimentary to a profile of a periphery of the hinged internal segment 114. The hinged internal segment 114 further comprises an opening or bore 120. The opening 120 is adapted to receive an elongated fastener, such as coupler 50, to secure the bracket 100 and the faceguard 35 to the shell 11. The hinged internal segment 114 additionally has a countersink 121, aligned with the opening 120, to enable a head portion of the fastener to reside below the outer portion 122.

Figure 4C:
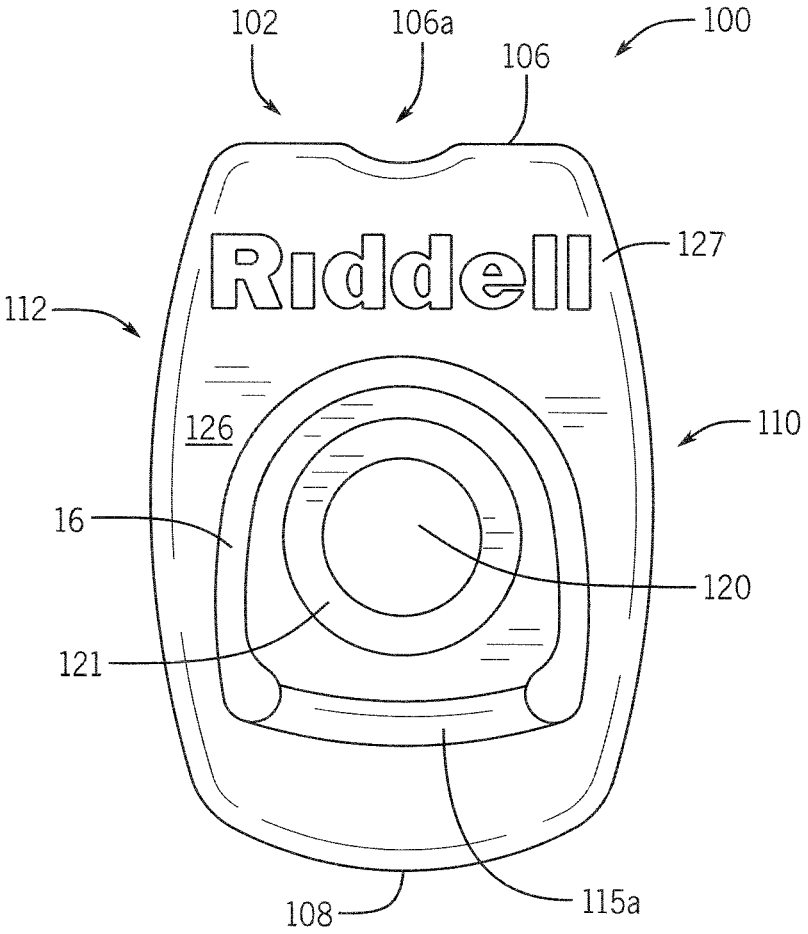
FIG. 4*c* is a top view of the dynamic faceguard connector of the energy attenuating system of the helmet of FIG. 1.

As shown in FIGS. 4*a*-4*c*, 9, 9*a*, and 10, the outer bracket portion 122, including the outer first side rail segment 110*a*, the outer second side rail segment 112*a*, and the frontal tab outer segment 108*a*, defines an inclined outer wall surface 126 of the outer portion 122 that extends between the front tab 108 and the rear flange 106. As shown in FIG. 4*c*, the inclined outer wall surface 126 is configured to allow for the inclusion of text, such as a company identifier or logo. The inner bracket portion 124, including the inner first side rail segment 110*b*, the second outer side rail segment 112*b*, and the frontal tab inner segment 108*b*, defines a generally planar inner wall surface 128. Referring to FIG. 4*b*, the internal portion 114*b* of the inner portion 114 has an inner surface 114*d* that is slightly recessed from the inner wall surface 128. Preferably, an outer surface 114*c* of the outer segment 114*a* of the internal segment 114 is recessed from the outer wall 126 of the outer portion 122 thereby forming an offset K. Further, an internal cavity 117 is formed between the internal segment 114 the internal portions of the side rails 110, 112 and the flange 106. Preferably, the offset K varies over the length of the bracket 100, in that the offset K is smaller near the frontal tab 108 and the offset K is larger near the peripheral flange 106. The offset K facilitates pivotal movement of the peripheral segment 113 relative to the internal segment 114 upon an impact to the faceguard 35. In addition, one of the outer portion 122 and the inner portion 124 has a protrusion 130 that interacts with a recess 132 formed in the other of the outer portion 122 and the inner portion 124, preferably at a location adjacent the hinge line of the internal segment 114. In the embodiment discussed above, the bracket's movable segment is the peripheral segment 113 and the stable segment is the internal segment that are operatively connected. Alternatively, the peripheral segment 113 is fixed and internal segment 114 is movable when an impact force is applied to the faceguard 35, as discussed below. In another alternate configuration, the bracket 100 includes a front segment and a rear segment, wherein one of the segments moves when an impact force is applied to the faceguard 35 and the other of the segments remains stable and secured to the shell 11.

FIGS. 6 and 9 show the energy attenuating faceguard mounting system 14 in an installed or first position P1 (and prior to any impact to the helmet 10), wherein the faceguard 35 is dynamically connected to the helmet 10 by the connectors 16. The first position P1 reflects the connector 16 position before an impact is applied to the faceguard 35, or the post impact state where energy from an impact has been fully absorbed and dissipated by the energy attenuating faceguard mounting system 14. In the first position P1, upper bar members 52*a, b* extend between the connectors 16 but do not connect with the helmet 10 at or near the shell's brow region 11*c* or front bumper 202, thereby providing the gap G. Referring to FIG. 9, the inner wall 128 of the inner portion 124 is spaced a distance D1 from the outer surface 18 of the shell 11 at the interface area 11*e*. The distance D1 also represents the distance between the outer shell surface 18 and the inner first and second side rail segments 110*b*, 112*b*. In general terms, when an impact to the faceguard 35 occurs, the internal segment 114 remains substantially stable, but the flange 106 and the side rails 110, 112 of the peripheral segment 113 flex relative to the internal segment 114. Depending upon the magnitude and duration of an impact to the faceguard 35, this movement occurs in two directions—outward from the shell 11, and inward towards the shell 11—which provides the connector 16 with dynamic characteristics upon an impact to the faceguard 35. The faceguard 35 is shown in the Figures as single structure formed from a plurality of intersecting bar members. Alternatively, the faceguard 35 comprises distinct portions, such as an upper portion and a lower portion wherein each portion includes a plurality of intersecting bar members. This faceguard 35 configuration can result from the removal of the lower vertical bar members 39 (see FIG. 1) that extend from the lower portion to the upper portion. Assuming the resulting upper portion of the faceguard is secured to the helmet shell 11 by the dynamic connectors 16, the upper faceguard portion will behave in a manner consistent with that described below for both on-center and off-center impacts.

Figure 7:
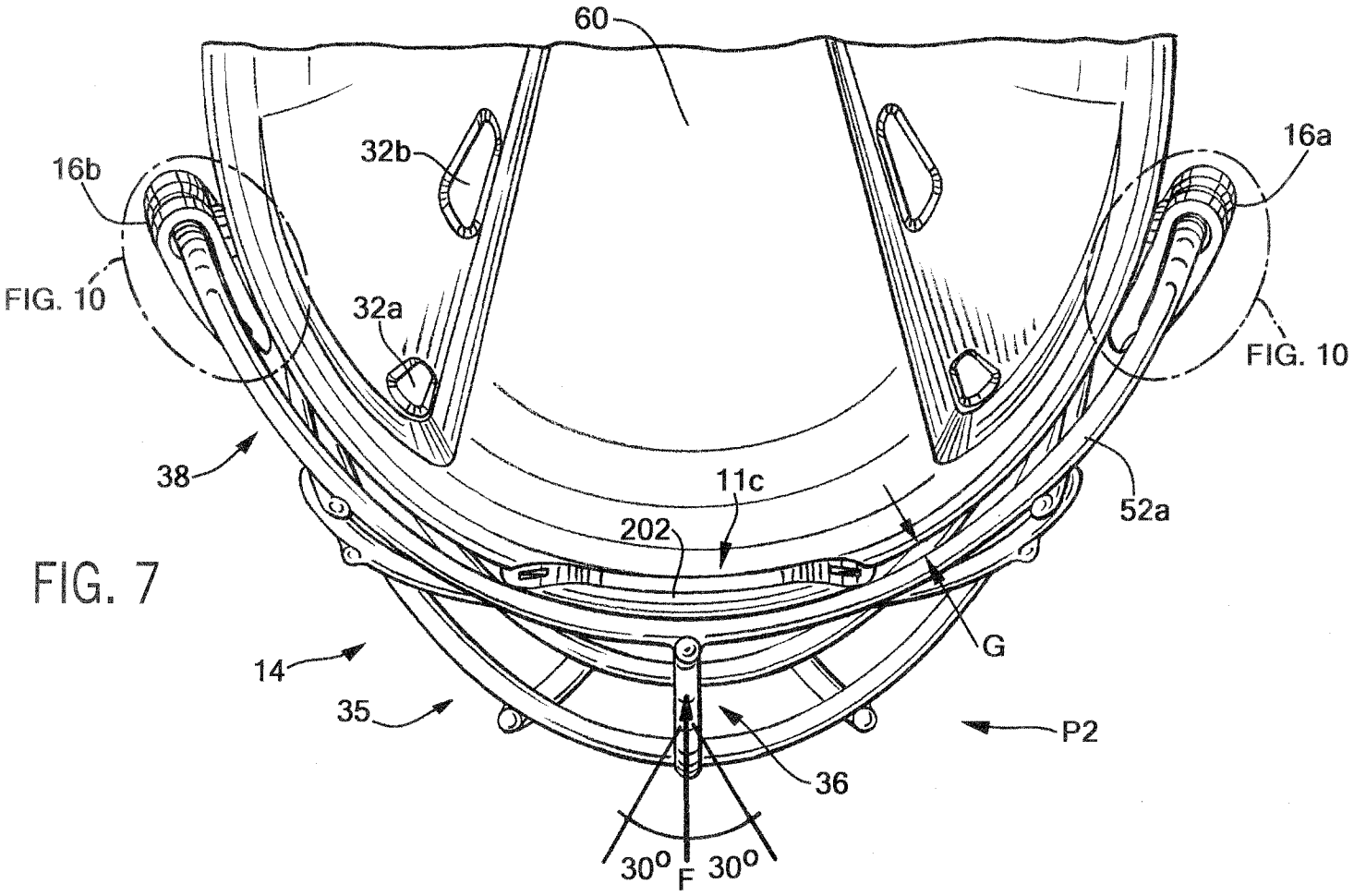
FIG. 7 is a partial top view of the helmet of FIG. 1 showing the energy attenuating system of the helmet wherein a generally on-center force F is applied to the faceguard.

FIGS. 7 and 10 show the energy attenuating faceguard mounting system 14 in a second position P2 wherein an "on-center" impact force F, that is substantially lateral, is applied to a center point 36 of the faceguard 35. The on-center impact F occurs within thirty degrees (30°) of the faceguard center point 36, which may be defined by a substantially vertical center bar member 37. Alternatively, the center bar member 37 is omitted and the center point 36 is located between two other vertical bar members, for example vertical bars in the upper or lower portion of the faceguard 35. When the on-center impact F occurs, the faceguard 35 is displaced towards the shell 11 whereby the bracket 100 flexes outward relative to (or away from) the outer shell surface 18 at the interface area 11*e*. Specifically, the peripheral flange 106, the first side rail 110 and the second side rail 112 move away from the outer shell surface 18 at the interface area 11*e*, while the internal segment 114 remains stable due to the securement with the helmet shell 11 provided by the coupler 50. Thus, the peripheral flange 106, the first side rail 110 and the second side rail 112 move relative to the internal segment 114 along the hinge line 115*a*. Referring to FIG. 10, a distance D2 (where D2 exceeds D1) exists between the outer shell surface 18 and the inner wall 128 of the inner portion 124. The distance D2 also represents the distance between the outer shell surface 18 and the inner first and second side rail segments 110*b*, 112*b*. By referencing FIG. 10 for both connectors 16, FIG. 7 indicates that both faceguard connectors 16 will behave similarly and experience the same amount of flex during an on-center impact. However, it is understood that an impact force F that is not purely on-center but that falls within 30 degrees of on-center (or within the total 60 degree window) may cause one connector 16 to behave slightly differently than a second connector 16. For example and referring to FIG. 7, an impact force that is applied 10 degrees off-center on a center left portion of the face guard 35 will cause the helmet's left connector 16*a* to flex less than the helmet's right connector 16*b*. Therefore, the distance D2 between the left connector 16*a* and the outer shell surface 18 at the interface area 11*e* is less than the distance D2 between the right connector 16*b* and the outer shell surface 18 at the interface area 11*e*.

The movement of the faceguard 35 provided by the dynamic connectors 16 dissipates energy received by the faceguard 35 from the on-center impact, and temporarily reduces the gap G between the faceguard upper bars 52 and the shell 11 (as compared to the gap G in the first position P1 of FIG. 6). Under most impact conditions, the gap G is temporarily reduced but not entirely eliminated, whereby the transmission of faceguard impact forces to the shell front 21 is reduced. Due to the nature of the faceguard impact, the dynamic faceguard connector 16 experiences both inward and outward movement relative to the shell 11 during an on-center impact. The extent of this dual movement varies with a number of impact factors, including the speed of the impact, the duration of the impact and the faceguard location of the impact. Nonetheless, under a moderate or severe on-center impact, the connector bracket 100 rapidly moves (or flexes) outward relative to the shell 11 and then inward relative to the shell 11 several times per impact. In this regard, the connector's flange 106 and side rails 110, 112 oscillate back and forth about the stable internal segment 114 until the impact energy is sufficiently dissipated. To further aid energy attenuation, the bar members 39 of the faceguard 35, including the uppermost bars 52*a, b* elastically deform upon an impact. During a significant on-center impact force F, the faceguard 35 elastically deforms such that the opposed peripheral faceguard regions 38 move outward or away from the helmet shell 11. Thus, the dynamic faceguard connectors 16*a, b* facilitate and/or enable movement of the peripheral faceguard regions 38 that is substantially normal or substantially perpendicular to the outer shell surface 18 at the interface area 11*e* when an on-center impact force F is applied to the faceguard 35.

Figure 8:
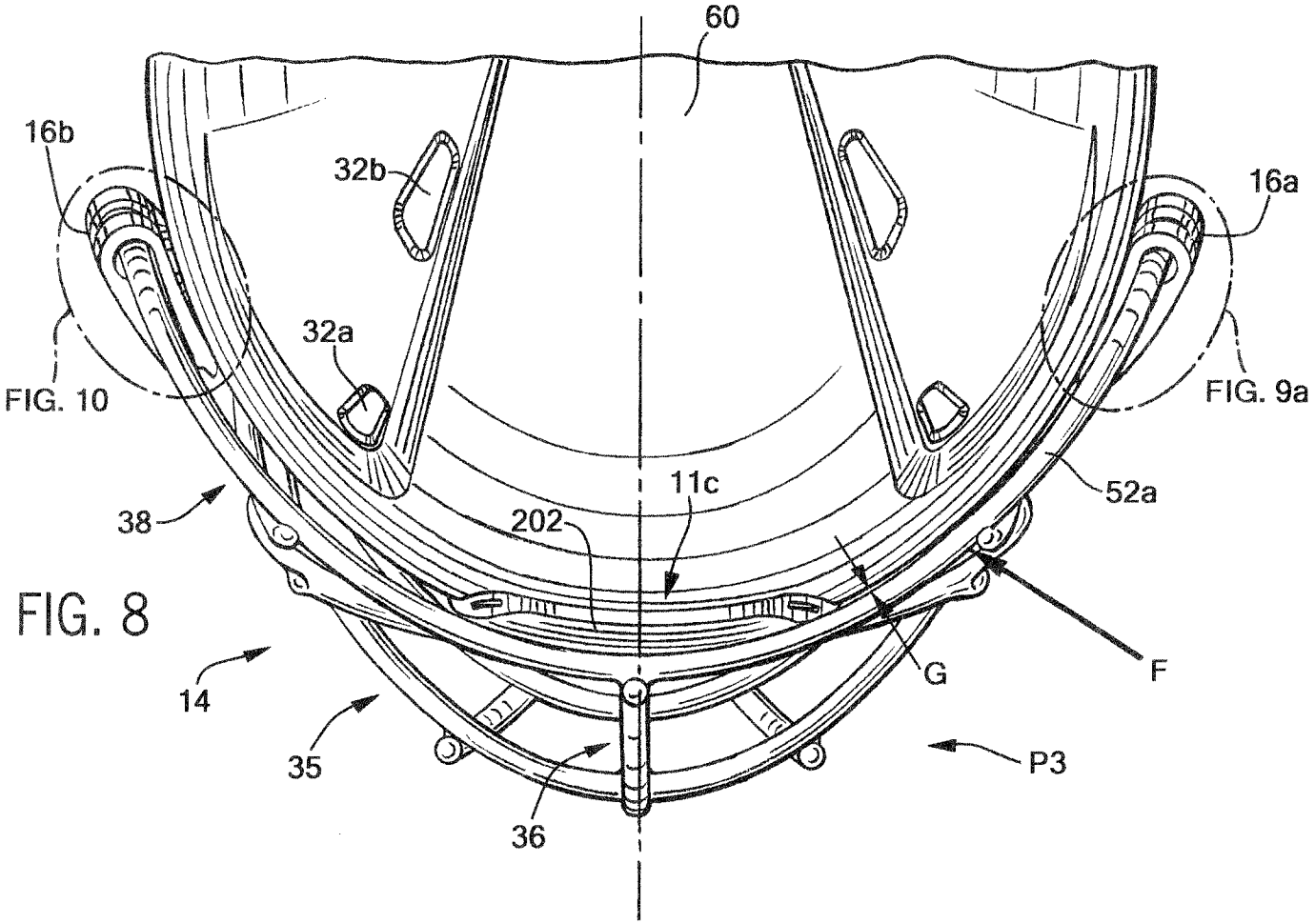
FIG. 8 is a partial top view of the helmet of FIG. 1 showing the energy attenuating system of the helmet wherein a generally off-center force F is applied to the faceguard.

FIGS. 8, 9*a*, and 10 show the energy attenuating faceguard mounting system 14 in a third position P3 wherein an "off-center" impact force F, that is substantially lateral, is applied to the faceguard 35. The off-center impact F occurs to the side of the face guard 35 beyond thirty degrees (30°) of the faceguard center point 36. Referring to FIG. 8, the off-center impact F occurs at a left portion of the faceguard 35, between a lowermost bar 52*e* and the uppermost bar 52*a*. Due to the off-center impact force F, the gap G on the left side of the face guard 35 is temporarily eliminated. The gap G on the right side of the face guard 35 is similar to that for the first position P1 (see FIG. 6), however, under certain impact conditions, this gap G may slightly, temporarily increase. When the off-center impact F occurs, the left faceguard connector 16*a* and the left peripheral faceguard portion 38*a* compresses towards the interface area 11*e* of the helmet shell 11, and the right faceguard connector 16*b* and the right peripheral faceguard portion 38*b* flexes away from the interface area 11*e* of the helmet shell 11. Thus, the faceguard connector 16 and the peripheral faceguard portion 38 located on an opposite side of the faceguard as the off-center impact force F initially moves outward and substantially normal relative to the interface area 11*e* of the shell 11 while the faceguard connector 16 and the peripheral faceguard portion 38 on the same side as the impact force F initially moves inward and substantially normal relative to the interface area 11*e* of the shell 11. Upon an off-center impact, the faceguard connectors 16 behave differently which demonstrates the dynamic nature of the connector 16. When the off-center impact F occurs, the right connector 16*b*, including the bracket 100, behaves in the manner described above and shown in FIG. 10. The bracket 100 of the left connector 16*a* initially moves towards the interface area 11*e* of the helmet shell 11 and depending upon the magnitude and duration of the impact F, the inner bracket wall 128 makes contact with the outer shell surface 18. In this manner, the distance D3 between the outer shell surface 18 and the inner wall 128 of the inner portion 124 is temporarily eliminated. The bracket 100 of the left connector 16*a* then moves away from the shell outer surface 18. When the off-center impact force F has a lesser magnitude and/or duration, the inner portion 124 of the connector 16*a* may not contact the outer shell surface 18 and the distance D3 is less than D2 or D1. Thus, the faceguard connector 16 on the same side of the faceguard 35 as the off-center impact F initially moves towards the helmet shell 11, and the connector 16 on the other side of the faceguard 35 initially moves away from the helmet shell 11.

While substantially lateral or horizontal impact forces F are discussed above, it has also been observed that an on-center impact force F applied in a vertically downward direction to the faceguard 35 cause the dynamic faceguard connectors 16 to flex outward relative to the shell 11. This behavior is similar to when a lateral impact force F is applied on-center to the faceguard 35. Conversely, an on-center impact force F applied in a vertically upward direction (towards the crown 19) to the faceguard 35 cause the dynamic faceguard connectors 16 to flex inward relative to the shell 11. Testing the inventive helmet 10 involved mounting it on a Hybrid III headform that is coupled to a test table that is movable along a single axis. A ram is moved axially along the single axis in the same direction that the moveable table may travel. The ram was moved at different speeds, such as, for example, 5 m/s, 7 m/s, and/or 9 m/s, to deliver a force to the faceguard 35 of the helmet 10. Sensors within the headform measure lateral acceleration as well as severity index of the impact of the ram with the helmet 10. This testing has shown that the helmet 10 and its energy attenuating facemask mounting system 14 significantly reduces both lateral acceleration and severity index of impacts delivered by the ram to the faceguard 35 over a variety of impact speeds.

Figure 5A:
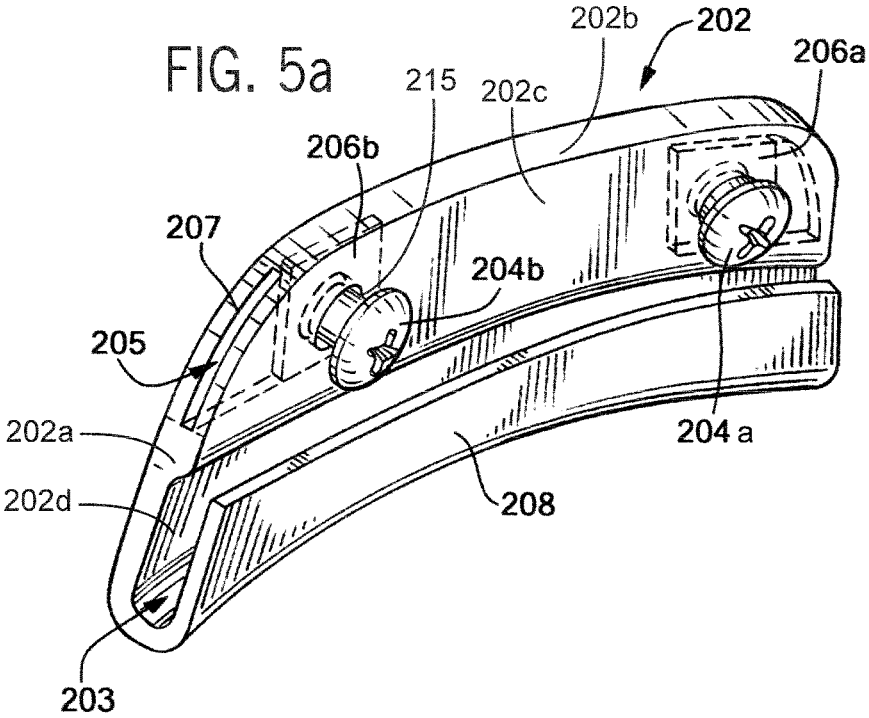
FIG. 5*a* is a perspective view of a nameplate used with the helmet of FIG. 1.
Figure 5B:
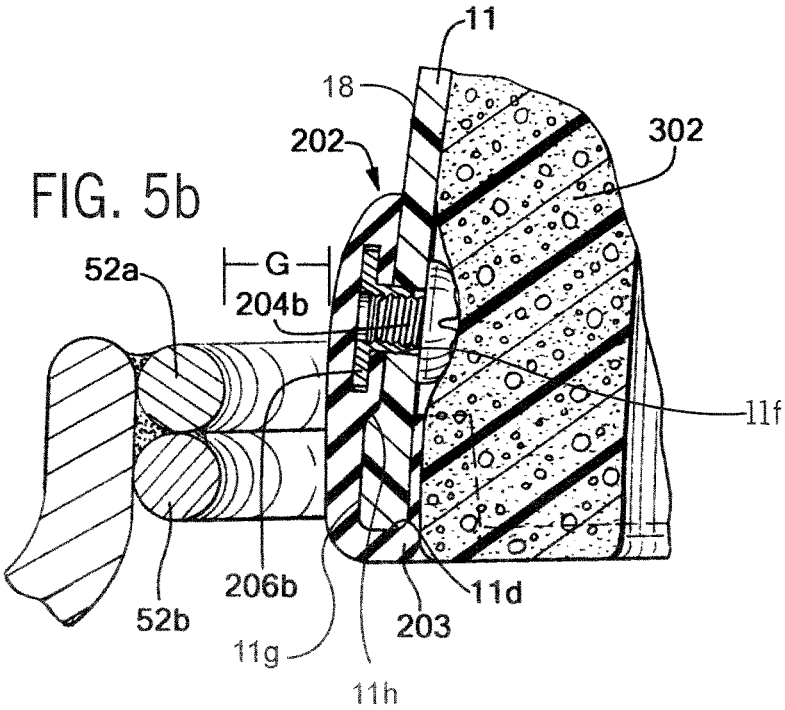
FIG. 5*b* is a cross-sectional view of the nameplate of FIG. 5*a*, showing the nameplate mounted to the helmet and a gap G between the faceguard member and the helmet.

FIGS. 5*a* and 5*b* show a front bumper or nameplate 202 affixed to the brow region 11*c* of the shell 11 by internal fasteners that are not externally visible. The bumper 202 has a curvilinear configuration that substantially corresponds to the configuration of the brow region 11*c*, and facilitates the positioning and securement of the internal padding assembly 300. Fasteners 204*a*, 204*b* pass through openings 11*f* in the shell 11 and bumper opening 215 and are received by respective nuts 206*a*, 206*b* that are secured within an internal pocket 205 formed in the bumper 202. The fastener 204*a*, 204*b* extends through only a portion of the bumper 202 and no fastener extends through the entirety of the bumper 202. Preferably, the pockets 205 are in an opposed relationship, wherein each pocket 205 has an access slot 207 aligned with the periphery of the bumper 202, such as a sidewall 202*a* or a top wall 202*b*. As shown in FIG. 5*a*, the slot 207 is formed in the sidewall 202*a* of the bumper 202 and leads to the pocket 205 and the bumper opening 215, which are both positioned a distance from the sidewall 202*a*. The internal pocket 205 retains the nuts 206*a*, 206*b* as the helmet 10 lacks any connectors for the upper bar 52 of the faceguard 35 at the brow region 11*c* of the shell 11. The bumper 202 also includes a lower groove 203 that is defined by an internal flange 208 and that engages the frontal opening upper edge 11*d* of the shell 11 to facilitate engagement thereto. As shown in FIGS. 5*a* and 5*b*, a first inner wall 202*c* and a second inner wall 202*d* of the bumper 202 resides adjacent the outer surface 18 of the shell 11 and the flange 208 is positioned between the frontal opening upper edge 11*d* and a front pad 302 of the internal pad assembly 300. The bumper 202 contains an outer surface or panel that allows for indicia, such as the manufacturer of the helmet 10, or the name of a team of the wearer 500. Because the nuts 206*a*, 206*b* are internally retained within the pocket 205 and there is no faceguard connection point at the brow region 11*c*, the helmet 10 lacks any externally visible fastener hardware at the brow region 11*c*. In contrast, conventional helmets utilize external fastening hardware to secure the faceguard to the bumper and helmet, which reduces the aesthetic appearance of the conventional helmet.

Figure 14:
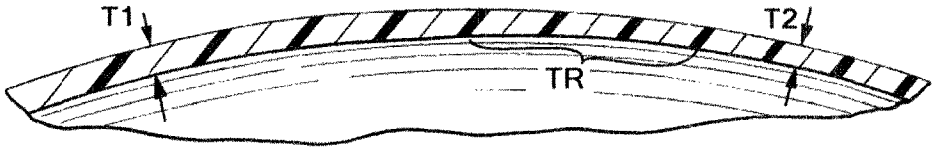
FIG. 14 is a partial cross-sectional view of the shell portion of the helmet shown within dotted lines of FIG. 13.

FIGS. 11-16 show the shell 11 having a transition region TR, where the thickness of the shell 11 varies from a first thickness at the front portion 21 of the shell 11 to the rear portion 20 of the shell 11. In the embodiment shown, the transition region TR is a transverse band that extends between the symmetric left and right side regions 24*a,b* of the shell 11, preferably rearward of the ear openings 12. Preferably, the transition region extends from the lower shell edge 22 of the left shell portion 22*a* to the lower shell edge 22 of the right shell portion 22*b*. The transition region TR intersects and includes the raised central band 60 that extends from the front shell portion 21 and along the crown 19. The transition region TR is roughly 1 inch wide and the thickness of the shell 11 transitions from about 0.125 inches in the front shell portion 21 to about 0.100 inches in the rear shell portion 20. This reduction in width reduces the weight of the helmet 10, and the amount of raw material used to form the shell 11. FIG. 12 provides a frontal view of the helmet 10, with a central axis A-A dividing the shell 11 into the left region 24*a* and right region 24*b*. The shell 11 includes an internal rib extending along the inner shell surface 17 from the rear shell portion 20 upward through the crown 19 and towards the front shell portion 21. Section plane 13-13, corresponding to the cross-section of FIG. 13, is taken slightly right of the central axis A-A (as viewed in the Fig.) and beyond the internal rib on the left shell portion 22*a*. Referring to FIG. 14, the shell 11 has a frontal shell segment with a first thickness T1 forward of the transition region TR and a rear shell segment with a second thickness T2 rearward of the transition region TR, wherein the first thickness T1 exceeds the second thickness T2.

Figure 15:
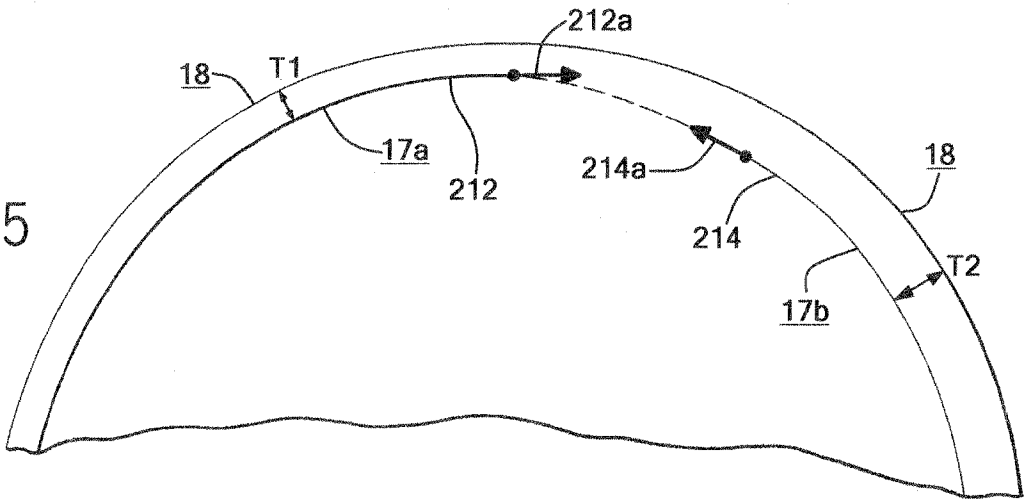
FIG. 15 is a partial sectional view of a transitional region of the shell portion of the helmet showing the curvature of a front portion of the shell and a rear portion of the shell.
Figure 16:
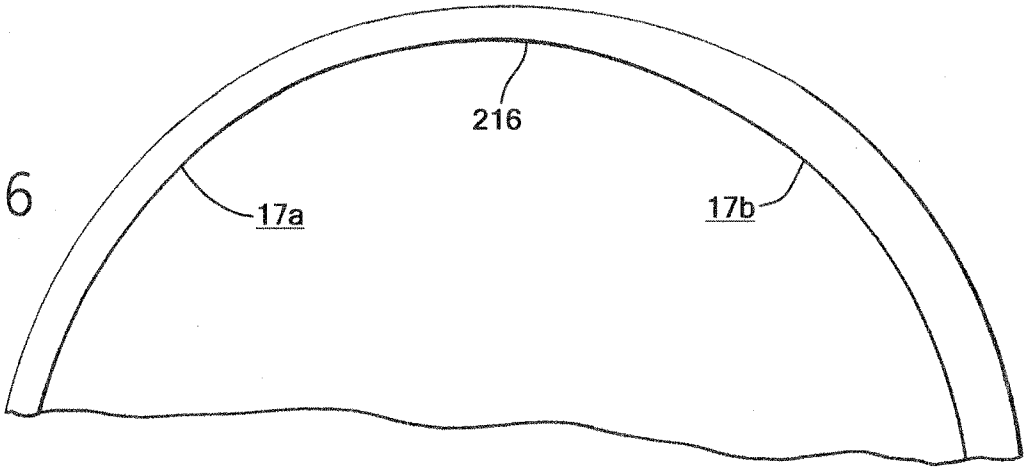
FIG. 16 is a partial sectional view of a transitional region of the shell portion of the helmet showing the curvature of the front portion of the shell, the rear portion of the shell, and a transitional portion of the shell; and, FIG. 17 is a rear view of the helmet of FIG. 1.

Referring to the schematic views of FIGS. 15 and 16, the transition region TR extends between the two thicknesses T1, T2. The first thickness T1 is defined between an inner frontal shell surface 17*a* and the outer shell surface 18, while the second thickness T2 is defined between an inner rear shell surface 17*b* and the outer shell surface 18. The inner frontal shell surface 17*a* has a first radius of curvature 212 and a tangential arrow 212*a* thereof, as well as a second radius of curvature 214 and a tangential arrow 214*a* thereof. To provide a substantially smooth configuration to the inner shell surface 17 that avoids abrupt or sharp changes to the shell geometry, it is preferable that the transition region TR has a radius of curvature 216 (see FIG. 16) that is tangential to both the frontal shell surface 17*a* and the rear shell surface 17*b* proximate the arrows 212*a*, 214*a*, respectively While the specific embodiments have been illustrated and described, numerous modifications come to mind without significantly departing from the spirit of the invention, and the scope of protection is only limited by the scope of the accompanying Claims.

We claim:

1. A football helmet comprising:

a shell configured to receive a head of a wearer of the football helmet, the shell having:

a front region, a rear region, a left side region and a right side region, wherein each side region has an ear flap with an ear opening having a non-circular configuration, a raised central band integrally formed as part of the shell and extending rearward from the front region of the shell, a first raised lateral ridge extending from a left side of the raised central band towards the left side region of the shell, a second raised lateral ridge extending from a right side of the raised central band towards the right side region of the shell, a first frontal vent opening having a non-circular configuration, wherein the first frontal vent opening is positioned adjacent to both the raised central band and the first raised lateral ridge, and a second frontal vent opening having a non-circular configuration, wherein the second frontal vent opening is positioned adjacent to both the raised central band and the second raised lateral ridge; and a faceguard secured to the shell by at least two faceguard connectors.

2. The football helmet of claim 1, wherein the first and second frontal vent openings are positioned outside of both: (i) the raised central band and (ii) the first and second raised lateral ridges.

3. The football helmet of claim 1, wherein the left and right side regions of the shell include at least one angled wall that extends along an extent of the ear opening.

4. The football helmet of claim 1, further comprising:

a first chord extending: (i) between an uppermost point of the first frontal vent opening and an uppermost point of the second frontal vent opening, and (ii) and around the rear region of the shell;

a first rear vent opening having a non-circular configuration and an innermost point;

a second rear vent opening having a non-circular configuration and an innermost point; and wherein, when the football helmet is worn by the wearer, the first and second rear vent openings are positioned below the first chord.

5. The football helmet of claim 4, wherein the rear region of the shell comprises:

a first arrangement of angled walls, said arrangement of walls forming a first recess region in the rear portion of the shell that contains the first rear vent opening; and a second arrangement of angled walls, said arrangement of walls forming a second recess region in the rear portion of the shell that contains the second rear vent opening.

6. The football helmet of claim 4, wherein each ear opening has two edges that intersect to form a forward-most point, and wherein a second chord extends: (i) between said forward-most points of the ear openings, and (ii) around the rear region of the shell; and wherein the first and second rear vent openings are positioned above the second chord.

7. The football helmet of claim 4, further comprising a front bumper that is removably affixed to the front region of the shell, said front bumper has a front bumper width, and wherein a distance between the innermost points of the first and second rear vent openings exceeds the front bumper width.

8. The football helmet of claim 1, further comprising a front bumper that is removably affixed to a brow portion of the front region of the shell by at least one connector that extends through the shell and that is not externally visible, said front bumper has a front bumper width, and wherein the raised central band has a band width that extends between a first substantially linear sidewall and a second substantially linear sidewall, wherein an extent of said band width is greater than the front bumper width.

9. The football helmet of claim 8, further comprising:

a first plurality of crown vent openings formed in a crown region and positioned adjacent to the first sidewall of the raised central band; and a second plurality of crown vent openings formed in a crown region and positioned adjacent to the second sidewall of the raised central band.

10. The football helmet of claim 1, wherein the first and second lateral ridges have a sidewall segment that extends upward and rearward towards the ear flap and away from the raised central band.

11. The football helmet of claim 1, wherein the shell has a first thickness located at a first point in the front region and a second thickness located at a second point in the rear region, said second thickness being less than the first thickness.

12. The football helmet of claim 1, wherein the shell has: (i) a first thickness located at a point substantially centered between the first and second frontal vent openings and (ii) a second thickness located at a point that is positioned below a chord that extends between forward-most points of the ear openings and around the rear region of the shell, said second thickness is at least 15 percent less than the first thickness.

13. The football helmet of claim 1, wherein the faceguard connectors include an inner bracket portion and an outer bracket portion, and wherein an extent of the outer bracket portion has a substantially flat outer surface that includes a company logo.

14. A football helmet comprising:

an outer shell configured to receive a head of a wearer of the football helmet, the outer shell having:

a front region, a rear region, a left side region and a right side region, wherein each side region has an ear flap with an ear opening having a non-circular configuration, a raised central band integrally formed as part of the outer shell and extending rearward from the front region of the outer shell, a left raised lateral ridge extending from a left side of the raised central band towards the left side region of the outer shell, a right raised lateral ridge extending from a right side of the raised central band towards the right side region of the outer shell, a left frontal vent opening, wherein the left frontal vent opening is positioned outside of raised central band and adjacent to the left raised lateral ridge, a right frontal vent opening, wherein the right frontal vent opening is positioned outside of raised central band and adjacent to the right raised lateral ridge, a first chord extending: (i) between an uppermost point of the left frontal vent opening and an uppermost point of the right frontal vent opening, and (ii) around the left side region, the rear region, and the right side region of the outer shell, a first rear vent opening and a second rear vent opening, and wherein an extent of both the first and second rear vent openings are positioned below the first chord; and a faceguard secured to the outer shell by at least two faceguard connectors.

15. The football helmet of claim 14, wherein the rear region of the outer shell comprises:

a first arrangement of angled walls, said arrangement of walls forming a first recess region in the rear portion of the outer shell that contains the first rear vent opening; and a second arrangement of angled walls, said arrangement of walls forming a second recess region in the rear portion of the outer shell that contains the second rear vent opening.

16. The football helmet of claim 14, further comprising a front bumper that is removably affixed to the front region of the outer shell, said front bumper has a front bumper width, and wherein a distance between the innermost points of the first and second rear vent openings exceeds the front bumper width.

17. The football helmet of claim 14, further comprising a front bumper that is removably affixed to a brow portion of the front region of the outer shell by at least one fastener that extends through the outer shell and is not externally visible, said front bumper has a front bumper width, and wherein the raised central band has a band width that extends between a first substantially linear sidewall and a second substantially linear sidewall, wherein an extent of said band width is greater than the front bumper width.

18. The football helmet of claim 14, further comprising:

a first plurality of crown vent openings formed in a crown region and positioned adjacent to the first sidewall of the raised central band; and a second plurality of crown vent openings formed in a crown region and positioned adjacent to the second sidewall of the raised central band.

19. The football helmet of claim 14, wherein the outer shell has a first thickness located at a first point in the front region and a second thickness located at a second point in the rear region, said second thickness being less than the first thickness.

20. A football helmet comprising:

a shell configured to receive a head of a wearer of the football helmet, wherein when the football helmet is worn by the wearer, the shell has:

a front region, a rear region, a left side region and a right side region, wherein each side region has an ear flap with an ear opening having a forward-most point, a raised central band integrally formed as part of the shell and extending rearward from the front region of the shell, a first raised lateral ridge extending from a left side of the raised central band towards the left side region of the shell, a second raised lateral ridge extending from a right side of the raised central band towards the right side region of the shell, a first frontal vent opening positioned (i) in the front region of the shell, and (ii) adjacent to both the raised central band and the first raised lateral ridge, a second frontal vent opening positioned (i) in the front region of the shell, and (ii) adjacent to both the raised central band and the second raised lateral ridge, a first chord extending: (i) between an uppermost point of the first frontal vent opening and an uppermost point of the second frontal vent opening, and (ii) around the rear region of the shell, a second chord extending: (i) between the forward-most points of the ear openings, and (ii) around the rear region of the shell, a first rear vent opening having a non-circular configuration, wherein an extent of the first rear vent opening is positioned between the first and second chords, and a second rear vent opening having a non-circular configuration, wherein an extent of the second rear vent opening is positioned between the first and second chords;

a padding assembly residing with the shell; and a faceguard secured to the shell by at least two faceguard connectors.

21. The football helmet of claim 20, wherein the front region of the shell has a first thickness located at a first point, and wherein the rear region of the shell has a second thickness located at a second point, the second thickness being less than the first thickness.

22. The football helmet of claim 20, wherein the first and second lateral ridges have a sidewall segment that extends upward and rearward towards the ear flap and away from the raised central band.

23. The football helmet of claim 20, further comprising a front bumper that is removably affixed to the front region of the shell, said front bumper has a front bumper width, and wherein a distance between the innermost points of the first and second rear vent openings exceeds the front bumper width.

24. The football helmet of claim 20, wherein the raised central band has a band width that extends between a first substantially linear sidewall and a second substantially linear sidewall, wherein a distance between the outermost points of the first and second rear vent openings exceeds the band width.

25. The football helmet of claim 20, further comprising:

a first plurality of crown vent openings formed in a crown region of the shell and positioned adjacent to the first sidewall of the raised central band; and a second plurality of crown vent openings formed in a crown region and positioned adjacent to the second sidewall of the raised central band.

26. The football helmet of claim 21, wherein the first thickness is located at a point substantially centered between the first and second frontal vent openings and the second thickness is located at a point that is positioned below the second chord, said second thickness is at least 15 percent less than the first thickness.

27. The football helmet of claim 20, further comprising a front bumper that is removably affixed to a brow region of the shell by at least one fastener that extends through the shell, and wherein the football helmet lacks any externally visible fastener hardware at the brow region of the shell.

28. The football helmet of claim 27, wherein front bumper includes an outer surface that is configured to receive text labeling, and wherein said outer surface does not include any externally visible fastener hardware.

29. The football helmet of claim 20, wherein the shell further comprises:

a first recessed region formed by a first arrangement of angled walls, wherein an extent of the first recess region is positioned in the rear region of the shell and between the first and second chords, and a second recessed region formed by a first arrangement of angled walls, wherein an extent of the second recess region is positioned in the rear region of the shell and between the first and second chords.

* * * * *